US008381694B2

(12) United States Patent
Niiro

(10) Patent No.: US 8,381,694 B2
(45) Date of Patent: Feb. 26, 2013

(54) ENGINE VALVE CONTROLLER

(75) Inventor: Masaaki Niiro, Kanagawa (JP)

(73) Assignee: Nittan Valve Co., Ltd., Hadano-shi, Kanagawa (JP)

( * ) Notice: Subject to any disclaimer, the term of this patent is extended or adjusted under 35 U.S.C. 154(b) by 261 days.

(21) Appl. No.: 12/867,004

(22) PCT Filed: Feb. 27, 2008

(86) PCT No.: PCT/JP2008/053390

§ 371 (c)(1),
(2), (4) Date: Aug. 10, 2010

(87) PCT Pub. No.: WO2009/107204

PCT Pub. Date: Sep. 3, 2009

(65) Prior Publication Data

US 2010/0326386 A1 Dec. 30, 2010

(51) Int. Cl.
*F01L 1/34* (2006.01)

(52) U.S. Cl. ..... 123/90.17; 123/90.15

(58) Field of Classification Search ..... 123/90.15, 123/90.17, 90.31

See application file for complete search history.

(56) References Cited

U.S. PATENT DOCUMENTS

| | | | | |
|---|---|---|---|---|
| 5,152,263 | A | 10/1992 | Danieli | |
| 5,219,313 | A | 6/1993 | Danieli | |
| 6,199,522 | B1 | 3/2001 | Regueiro | |
| 6,213,071 | B1 * | 4/2001 | Lancefield et al. | 123/90.17 |
| 2002/0038639 | A1 | 4/2002 | Mae et al. | |
| 2002/0174843 | A1 | 11/2002 | Iwaki et al. | |

FOREIGN PATENT DOCUMENTS

| | | | |
|---|---|---|---|
| DE | 3438088 | A1 | 4/1986 |
| DE | 4107624 | A1 | 9/1992 |
| EP | 0 723 094 | A2 | 7/1996 |

(Continued)

OTHER PUBLICATIONS

International Search Report for PCT/JP2008/053390 mailed May 20, 2008.

(Continued)

*Primary Examiner* — Zelalem Eshete
(74) *Attorney, Agent, or Firm* — Roberts Mlotkowski Safran & Cole P.C.

(57) ABSTRACT

[PROBLEMS] To keep a determined phase angle without consuming power once the phase angle is determined.
[MEANS FOR SOLVING PROBLEMS] An outer cylinder part (10) is connected with an intermediate member (14). The intermediate member (14) is connected with an inner cylinder part (12) via a pin (74). Rotary drums (84, 86) are arranged on both sides of a roller (76) mounted to the intermediate member (14). When the rotation of one rotary drum transmits the rotating force of the one rotary drum to the other rotary drum via the intermediate member (14) and the roller (76), the one rotary drum moves to the side of the other rotary drum, and the pin (74) moves along the guide grooves (48, 50) of the inner cylinder part (12) to rotate the inner cylinder part (12) and the outer cylinder part (10) in directions opposite to each other along the circumferential direction. The intermediate member (14) moves along the axial direction of the inner cylinder part (12) with the movement of the pin (74) and is positioned at the position where the rotation of the rotary drums (84, 86) is stopped. Since the roller (76) does not rotate by torque inputted from the outer cylinder part (10) or a camshaft (2) at that time, the intermediate member (14) is brought into a self-locking state.

7 Claims, 17 Drawing Sheets

FOREIGN PATENT DOCUMENTS

| | | | |
|---|---|---|---|
| EP | 0723094 | A2 | 7/1996 |
| EP | 1030036 | A2 | 8/2000 |
| EP | 1403470 | A1 | 3/2004 |
| EP | 1785597 | A1 | 5/2007 |
| EP | 1832719 | A1 | 9/2007 |
| GB | 2327737 | A | 7/1997 |
| GB | 2327737 | A | 2/1999 |
| JP | 8200471 | A | 8/1996 |
| JP | 10-153105 | A | 6/1998 |
| JP | 8-200471 | A | 8/1998 |
| JP | 2001-164951 | A | 6/2001 |
| JP | 2002-371814 | A | 12/2002 |
| JP | 2003-120225 | A | 4/2003 |
| JP | 2007-231953 | A | 9/2007 |

OTHER PUBLICATIONS

International Preliminary Report on Patentability for PCT/JP2008/053390 mailed Oct. 14, 2010.

Extended European Search Report for PCT/JP2008/053390 mailed Sep. 14, 2011.

European Office action for corresponding EP Application No. EP08720938.3 dated May 15, 2012.

Japanese Notice of Rejection for JP Application No. JP2010-500480 dated Jun. 27, 2012 and partial translation of the Notice of Rejection.

EPO Search Report Application No. 121929772-2311 mailed Dec. 18, 2012.

* cited by examiner (b)

(a)

ENGINE VALVE CONTROLLER

TECHNICAL FIELD

The present invention relates to an engine valve controller that changes the rotation phase of a camshaft to open and close an intake valve or an exhaust valve of an engine, for controlling the opening and closing timing of the intake valve or the exhaust valve.

BACKGROUND ART

As a device for controlling the opening and closing timing of the intake valve or the exhaust valve of an engine, there has been proposed, for example, a phase variable device structured so that a sprocket to which a driving force of a crankshaft of the engine is transmitted and a camshaft that forms a valve train rotate in an integrated manner, and the sprocket and the camshaft rotate in synchronization, but when an electromagnetic brake unit causes a braking force to act on a rotary drum, a rotational delay occurs in the rotary drum with respect to the sprocket, and in connection with the rotational delay of the rotary drum, the phase of the camshaft with respect to the sprocket changes (refer to Patent Document 1).

In this phase variable device, since adopted is a structure where an engine oil is introduced to a relative sliding portion between a friction material of a clutch case and the rotary drum via an oil passage provided in the camshaft, an oil reservoir provided radially inside of the clutch case, and a cutout for oil introduction provided at a front edge portion of an inner peripheral wall of the clutch case, a relative sliding surface between the friction material and the rotary drum can be cooled.

Patent Document 1: Japanese Published Unexamined Patent Application No. 2002-371814 (Refer to page 4 to page 6, and FIG. 1 to FIG. 4.)

DISCLOSURE OF THE INVENTION

Problems to be Solved by the Invention

In the phase variable device described in Patent Document 1, when changing the phase of the camshaft with respect to the sprocket body, other than at an initial position of the phase angle, the braking force must be made to act on the rotary drum by drive of an electromagnetic clutch against the elasticity of a torsion coil spring (return spring), and even when the phase angle varies and after the phase angle varies (after the phase angle is determined), power associated with the drive of the electromagnetic clutch is consumed at all times. Moreover, in order to move an intermediate member along the axial direction of the camshaft according to the braking force acting on the rotary drum, a helical spline is formed on the intermediate member, a helical spline to be engaged with the helical spline of the intermediate member is formed on the sprocket body, a helical spline to be engaged with the helical spline of the intermediate member is formed on an inner cylinder part, and thus a phase angle conversion mechanism that converts an axial movement distance of the intermediate member to a phase angle is adopted, so that the phase angle conversion mechanism is complicated, resulting in an increase in cost.

The present invention has been made in view of the problems of the conventional techniques mentioned above, and an object thereof is to provide an engine valve controller that can keep the phase angle at a determined phase angle without consuming power once the phase angle is determined.

Means for Solving the Problems

In order to achieve the above object, an engine valve controller according to a first aspect of the invention includes an outer cylinder part to which a driving force of a crankshaft of an engine is transmitted, an inner cylinder part disposed relatively rotatable at an inner peripheral side of the outer cylinder part, and coaxially connected to a camshaft that opens and closes an intake valve or an exhaust valve of the engine, an intermediate member formed in a cylindrical shape and a part of which is freely slidably connected to the outer cylinder part, and disposed on an outer periphery of the inner cylinder part freely movably along an axial direction of the inner cylinder part, a position control mechanism that controls a position in an axial direction of the intermediate member according to an operation condition of the engine, and a phase adjustment mechanism that variably adjusts a phase between a sprocket on an outer periphery of the outer cylinder part and the camshaft according to a position in the axial direction of the intermediate member, in which the inner cylinder part and the intermediate member are connected to each other via the phase adjustment mechanism, the position control mechanism displaces the intermediate member in the axial direction in a current carrying state, and prevents, in a non-current carrying state, to a torque input from the sprocket on the outer periphery of the outer cylinder part or the camshaft to the intermediate member, an axial displacement of the intermediate member resulting from the torque input, the phase adjustment mechanism includes a pin fixed to the intermediate member and a part of which is protruded from an inner periphery of the intermediate member toward the outer periphery of the inner cylinder part and a guide groove formed spirally on the outer periphery of the inner cylinder part as a groove that guides the pin from a position corresponding to a most advanced angle phase to a position corresponding to a most retarded angle phase, and the pin moves within the guide groove according to an axial displacement of the intermediate member, to impart a force resulting from the axial displacement of the intermediate member to the guide groove as a force for a circumferential displacement of the inner cylinder part, and converts, in response to an axial displacement of the intermediate member, the axial displacement of the intermediate member to a circumferential displacement of the inner cylinder part.

(Operation) The position adjustment mechanism reaches a current carrying state only when the phase between the sprocket on the outer periphery of the outer cylinder part and the camshaft is variably adjusted, and displaces the intermediate member in the axial direction, and reaches a non-current carrying state in other cases to prevent axial displacement of the intermediate member. While a rotating force from the engine is being transmitted from the outer cylinder part via the intermediate member and the inner cylinder part to the camshaft, when the intermediate member is displaced in the axial direction by the position adjustment mechanism that is in a current carrying state, this axial displacement is converted by the phase adjustment mechanism to a circumferential displacement of the inner cylinder part, and the phase between the sprocket on the outer periphery of the outer cylinder part and the camshaft is adjusted as a result of the circumferential displacement of the inner cylinder part. More specifically, when the intermediate member is between the most advanced angle position and the most retarded angle position, with an axial displacement of the intermediate member, the pin moves within the guide groove according to the axial displacement of the intermediate member, a force resulting from the axial displacement of the intermediate member is imparted to the guide groove as a force for a circumferential displacement of the inner cylinder part, the inner cylinder part is displaced in the circumferential direction as a result of the axial displacement of the intermediate member, and according to the position in the axial direction of the intermediate member, the phase between the sprocket on the outer periphery of the outer cylinder part and the camshaft can be variably adjusted, and the intermediate member can be positioned at an advanced angle position or retarded angle position. Once a phase between the sprocket on the outer periphery of the outer cylinder part and the camshaft is determined, to a torque input from the sprocket on the outer periphery of the outer cylinder part or the camshaft to the intermediate member, the position adjustment mechanism being in a non-current carrying state prevents an axial displacement of the intermediate member resulting from this torque input. Therefore, once a phase between the sprocket on the outer periphery of the outer cylinder part and the camshaft is determined, even when torque is input from the sprocket on the outer periphery of the outer cylinder part or the camshaft, the phase between the sprocket on the outer periphery of the outer cylinder part and the camshaft can be kept at the designated phase without consuming power, and the power consumption can be reduced.

An engine valve controller according to a second aspect of the invention includes an outer cylinder part to which a driving force of a crankshaft of an engine is transmitted, an inner cylinder part disposed relatively rotatable at an inner peripheral side of the outer cylinder part, and coaxially connected to a camshaft that opens and closes an intake valve or an exhaust valve of the engine, an intermediate member formed in a cylindrical shape and a part of which is freely slidably connected to the outer cylinder part, and disposed on an outer periphery of the inner cylinder part freely movably along an axial direction of the inner cylinder part, a position control mechanism that controls a position in an axial direction of the intermediate member according to an operation condition of the engine, and a phase adjustment mechanism that variably adjusts a phase between a sprocket on an outer periphery of the outer cylinder part and the camshaft according to a position in the axial direction of the intermediate member, in which the inner cylinder part and the intermediate member are connected to each other via the phase adjustment mechanism, the position control mechanism displaces the intermediate member in the axial direction in a current carrying state, and prevents, in a non-current carrying state, to a torque input from the sprocket on the outer periphery of the outer cylinder part or the camshaft to the intermediate member, an axial displacement of the intermediate member resulting from the torque input, the phase adjustment mechanism includes a ball fixed to the intermediate member and a part of which is protruded from an inner periphery of the intermediate member toward the outer periphery of the inner cylinder part and a guide groove formed spirally on the outer periphery of the inner cylinder part as a groove that guides the ball from a position corresponding to a most advanced angle phase to a position corresponding to a most retarded angle phase, and the ball moves within the guide groove according to an axial displacement of the intermediate member, to impart a force resulting from the axial displacement of the intermediate member to the guide groove as a force for a circumferential displacement of the inner cylinder part, and converts, in response to an axial displacement of the intermediate member, the axial displacement of the intermediate member to a circumferential displacement of the inner cylinder part.

(Operation) The position adjustment mechanism reaches a current carrying state only when the phase between the sprocket on the outer periphery of the outer cylinder part and the camshaft is variably adjusted, and displaces the intermediate member in the axial direction, and reaches a non-current carrying state in other cases to prevent an axial displacement of the intermediate member. While a rotating force from the engine is being transmitted from the outer cylinder part via the intermediate member and the inner cylinder part to the camshaft, when the intermediate member is displaced in the axial direction by the position adjustment mechanism that is in a current carrying state, this axial displacement is converted by the phase adjustment mechanism to a circumferential displacement of the inner cylinder part, and the phase between the sprocket on the outer periphery of the outer cylinder part and the camshaft is adjusted as a result of the circumferential displacement of the inner cylinder part. More specifically, when the intermediate member is between the most advanced angle position and the most retarded angle position, with an axial displacement of the intermediate member, the ball moves within the guide groove according to the axial displacement of the intermediate member, a force resulting from the axial displacement of the intermediate member is imparted to the guide groove as a force for a circumferential displacement of the inner cylinder part, the inner cylinder part is displaced in the circumferential direction as a result of the axial displacement of the intermediate member, and according to the position in the axial direction of the intermediate member, the phase between the outer cylinder part and the camshaft can be variably adjusted, and the intermediate member can be positioned at an advanced angle position or retarded angle position. Once a phase between the sprocket on the outer periphery of the outer cylinder part and the camshaft is determined, to a torque input from the sprocket on the outer periphery of the outer cylinder part or the camshaft to the intermediate member, the position adjustment mechanism being in a non-current carrying state prevents an axial displacement of the intermediate member resulting from this torque input. Therefore, once a phase between the sprocket on the outer periphery of the outer cylinder part and the camshaft is determined, even when torque is input from the sprocket on the outer periphery of the outer cylinder part or the camshaft, the phase between the sprocket on the outer periphery of the outer cylinder part and the camshaft can be kept at the designated phase without consuming power, and the power consumption can be reduced.

An engine valve controller according to a third aspect of the invention is the engine valve controller according to the first or second aspect of the invention in which the position control mechanism includes a first ramp formed, at one axial end side of an outer periphery of the intermediate member, in a direction inclined with respect to a line perpendicular to a central axis of the intermediate member and along a circumferential direction, a second ramp formed, at the other axial end side of the outer periphery of the intermediate member, in a direction inclined in an opposite direction to the first ramp with respect to a line perpendicular to a central axis of the intermediate member and along a circumferential direction, a plurality of rotary drums disposed, with the first ramp and the second ramp interposed therebetween, separated from each other on the outer peripheral side of the intermediate member, and rotatably disposed around the inner cylinder part, a plurality of electromagnetic clutches that generate an electromagnetic force at an advance angle and a retard angle, stop generating an electromagnetic force in other cases, impart a rotating force to one of the rotary drums at the advance angle, and at the retard angle, impart a rotating force to the other of the rotary drums, and a roller that is freely rotatably disposed at a section between the one rotary drum and the other rotary drum of the outer periphery of the intermediate member, and rotates receiving a rotating force from the one rotary drum or the other rotary drum, and on an opposed surface side of the one rotary drum to the other rotary drum, a third ramp that is engageable with the first ramp and for pressing the first ramp toward the camshaft is formed, and on an opposed surface side of the other rotary drum to the one rotary drum, a fourth ramp that is engageable with the second ramp and for pressing the second ramp in a direction to separate from the camshaft is formed.

(Operation) In the case of performing advance angle control, while the intermediate member is rotating along with the outer cylinder part, when an electromagnetic force is generated from one electromagnetic clutch to impart a rotating force to one rotary drum, as a result of a rotation of the one rotary drum, the third ramp of the one rotary drum presses the first ramp toward the camshaft, and rotates the roller. At this time, the intermediate member moves toward the camshaft as a result of the third ramp pressing the first ramp toward the camshaft. Thereafter, when the one electromagnetic clutch is brought into a non-current carrying state, rotation of the one rotary drum is stopped, movement of the intermediate member is stopped, and the intermediate member is positioned at an arbitrary advanced angle position. On the other hand, while the intermediate member is at an advanced angle position, when an electromagnetic force is generated from the other electromagnetic clutch to impart a rotating force to the other rotary drum, as a result of a rotation of the other rotary drum, the fourth ramp of the other rotary drum presses the second ramp in the direction to separate from the camshaft, and rotates the roller. At this time, the intermediate member moves in the direction to separate from the camshaft as a result of the fourth ramp pressing the second ramp in the direction to separate from the camshaft. Thereafter, when the other electromagnetic clutch is brought into a non-current carrying state, the intermediate member is positioned at an arbitrary retarded angle position. More specifically, by bringing either electromagnetic clutch into a current carrying state only when moving the intermediate member to an arbitrary advanced angle or retarded angle position and bringing each electromagnetic clutch into a non-current carrying state in other cases, the intermediate member can be set to the arbitrary advanced angle or retarded angle position, and the power consumption can be reduced.

An engine valve controller according to a fourth aspect of the invention is the engine valve controller according to the third aspect of the invention in which, where an inclination angle of the first ramp, second ramp, third ramp, and fourth ramp is provided as θ, a force acting from the roller on the one rotary drum or the other rotary drum, which is a force parallel with a central axis of each rotary drum, is provided as P, journal friction acting in the circumferential direction of the one rotary drum or the other rotary drum is provided as Fr, and a coefficient of friction between the one rotary drum or the other rotary drum and the intermediate member is provided as μ, to a torque input from the outer cylinder part or camshaft to the intermediate member when the intermediate member is at an arbitrary advanced angle position or retarded angle position and an axial displacement for the intermediate member is not performed, the inclination angle θ satisfies a relationship of:

$$P\times\cos(\theta)-P\times\mu-Fr<0.$$

(Operation) Since the above formula takes a negative value even when torque is input from the outer cylinder part or the camshaft to the intermediate member when the intermediate member is at an arbitrary advanced angle position or retarded angle position and advance angle control or retard angle control is not performed, the roller is in a non-moving (non-rotating) state, torque is never transmitted from the roller to one rotary drum or the other rotary drum, and the intermediate member is locked to the arbitrary advanced angle position or retarded angle position to reach a self-locking state.

An engine valve controller according to a fifth aspect of the invention is the engine valve controller according to the third or fourth aspect of the invention in which the rotary drums are disposed between a stopper fixed to an outer periphery of one axial end portion of the inner cylinder part and the outer cylinder part, an elastic body is mounted between one of the rotary drums and the stopper, and by an elastic force of the elastic body, the rotary drums are pressed toward the camshaft.

(Operation) Since the rotary drums are pressed toward the camshaft by the elastic force of the elastic body, even when there is a torque input from the outer cylinder part or the camshaft after a phase angle between the outer cylinder part and the camshaft is determined, a movement of the intermediate member in the direction to separate from the camshaft due to this torque input can be prevented. More specifically, once a phase angle between the outer cylinder part and the camshaft is determined, even when a reaction force is received from the camshaft, the drive shaft side including the outer cylinder part and the driven shaft side including the inner cylinder part can be more reliably brought into a self-locking state without consuming power, the phase angle between the outer cylinder part and the camshaft can be more reliably kept at the phase angle determined according to the position of the intermediate member, and the power consumption can be reduced.

An engine valve controller according to a sixth aspect of the invention includes an outer cylinder part to which a driving force of a crankshaft of an engine is transmitted, an inner cylinder part disposed relatively rotatable at an inner peripheral side of the outer cylinder part, and coaxially connected to a camshaft that opens and closes an intake valve or an exhaust valve of the engine, a connection pin disposed freely movably along an axial direction of the inner cylinder part, for connecting the inner peripheral side of the outer cylinder part and an outer peripheral side of the inner cylinder part, a position control mechanism that controls a position of the connection pin in the axial direction of the inner cylinder part according to an operation condition of the engine, and a phase adjustment mechanism that variably adjusts a phase between a sprocket on an outer periphery of the outer cylinder part and the camshaft according to a position of the connection pin in the axial direction of the inner cylinder part, in which the position control mechanism displaces the connection pin in the axial direction of the inner cylinder part in a current carrying state, and prevents, in a non-current carrying state, to a torque input from the sprocket on the outer periphery of the outer cylinder part or the camshaft to the connection pin, a displacement of the connection pin in the axial direction of the inner cylinder part resulting from the torque input, the phase adjustment mechanism includes, as grooves that guide the connection pin from a position corresponding to a most advanced angle phase to a position corresponding to a most retarded angle phase, a first guide groove formed spirally on the outer periphery of the inner cylinder part and a second guide groove formed, on the inner periphery of the outer cylinder part, along an axial direction of the outer cylinder part, both end sides of the connection pin move within the first guide groove and second guide groove according to an axial displacement by the position control mechanism, to impart a force resulting from the axial displacement by the position control mechanism as a force for a circumferential displacement of the inner cylinder part, and converts, in response to a displacement of the connection pin in the axial direction of the inner cylinder part, the displacement of the connection pin in the axial direction of the inner cylinder part to a circumferential displacement of the inner cylinder part.

(Operation) The position adjustment mechanism reaches a current carrying state only when the phase between the outer cylinder part and the camshaft is variably adjusted, and displaces the connection pin along the axial direction of the inner cylinder part, and reaches anon-current carrying state in other cases to prevent a displacement of the connection pin in the axial direction of the inner cylinder part. While a rotating force from the engine is being transmitted from the outer cylinder part via the connection pin and the inner cylinder part to the camshaft, when the connection pin is displaced along the axial direction of the inner cylinder part by the position adjustment mechanism that is in a current carrying state, this axial displacement is converted by the phase adjustment mechanism to a circumferential displacement of the inner cylinder part, and the phase between the outer cylinder part and the camshaft is adjusted as a result of the circumferential displacement of the inner cylinder part. More specifically, when the connection pin is between the most advanced angle position and the most retarded angle position, with a displacement of the connection pin along the axial direction of the inner cylinder part, one longitudinal end side of the connection pin moves within the first guide groove, the other longitudinal end side of the connection pin moves within the second guide groove, a force resulting from the displacement of the connection pin in the axial direction of the inner cylinder part is imparted to the first guide groove as a force for a circumferential displacement of the inner cylinder part, the inner cylinder part is displaced in the circumferential direction as a result of the displacement of the connection pin in the axial direction of the inner cylinder part, and according to the position of the connection pin in the axial direction of the inner cylinder part, the phase between the outer cylinder part and the camshaft can be variably adjusted, and the connection pin can be positioned at an advanced angle position or retarded angle position. Once a phase between the outer cylinder part and the camshaft is determined, to a torque input from the outer cylinder part or the camshaft to the intermediate member, the position adjustment mechanism being in a non-current carrying state prevents a displacement of the connection pin in the axial direction of the inner cylinder part resulting from this torque input. Therefore, once a phase between the outer cylinder part and the camshaft is determined, even when torque is input from the outer cylinder part or the camshaft, the phase between the outer cylinder part and the camshaft can be kept at the designated phase without consuming power, and the power consumption can be reduced.

An engine valve controller according to a seventh aspect of the invention is the engine valve controller according to the sixth aspect of the invention in which the position control mechanism includes a plurality of rotary drums freely rotatably disposed between the inner cylinder part and the outer cylinder part, and disposed adjacent to each other along a radial direction of the outer cylinder part, and a plurality of electromagnetic clutches that generate an electromagnetic force in a current carrying state, stop generating an electromagnetic force in a non-current carrying state, impart a rotating force to one of the rotary drums at an advance angle resulting from a current supply, and at a retard angle resulting from a current supply, impart a rotating force to the other of the rotary drums, and in one of the rotary drums, a first guide hole to insert therethrough the connection pin is linearly formed in a direction inclined with respect to a line perpendicular to a central axis of the one rotary drum and along a circumferential direction, in the other rotary drum, a second guide hole to insert therethrough the connection pin is linearly formed in a direction inclined in an opposite direction to the first guide hole with respect to a line perpendicular to a central axis of the other rotary drum and along a circumferential direction, a pair of edges along a longitudinal direction of the first guide hole are formed as first ramps, and a pair of edges along a longitudinal direction of the second guide hole are formed as second ramps.

(Operation) In the case of performing advance angle control, while the inner cylinder part is rotating along with the outer cylinder part, when an electromagnetic force is generated from one electromagnetic clutch to impart a rotating force to one rotary drum, as a result of a rotation of the one rotary drum, the first ramp of the one rotary drum presses the connection pin toward the camshaft, and then both longitudinal end sides of the connection pin move along the first guide groove and the second guide groove, an intermediate portion of the connection pin moves along the first guide hole, and the connection pin as a whole moves toward the camshaft. Thereafter, when the one electromagnetic clutch is brought into a non-current carrying state, rotation of the one rotary drum is stopped, movement of the connection pin is stopped, and the connection pin is positioned at an arbitrary advanced angle position. On the other hand, while the connection pin is at an advanced angle position, when an electromagnetic force is generated from the other electromagnetic clutch to impart a rotating force to the other rotary drum, as a result of a rotation of the other rotary drum, the second ramp of the other rotary drum presses the connection pin in the direction to separate from the camshaft, and then both longitudinal end sides of the connection pin move along the first guide groove and the second guide groove, an intermediate portion of the connection pin moves along the second guide hole, and the connection pin as a whole moves in the direction to separate from the camshaft. Thereafter, when the other electromagnetic clutch is brought into a non-current carrying state, the connection pin is positioned at an arbitrary retarded angle position. More specifically, by bringing either electromagnetic clutch into a current carrying state only when moving the connection pin to an arbitrary advanced angle or retarded angle position and bringing each electromagnetic clutch into a non-current carrying state in other cases, the connection pin can be set to the arbitrary advanced angle or retarded angle position, and the power consumption can be reduced.

An engine valve controller according to an eighth aspect of the invention is the engine valve controller according to the seventh aspect of the invention in which, where an inclination angle of the first ramp and second ramp is provided as $\theta$, a force acting from the connection pin on the one rotary drum or the other rotary drum, which is a force parallel with a central axis of each rotary drum, is provided as P, journal friction acting in the circumferential direction of the one rotary drum or the other rotary drum is provided as Fr, and a coefficient of friction between the one rotary drum or the other rotary drum and the connection pin is provided as $\mu$, to a torque input from the outer cylinder part or camshaft to the connection pin when the connection pin is at an arbitrary advanced angle position or retarded angle position and an axial displacement along the axial direction of the inner cylinder part for the connection pin is not performed, the inclination angle θ satisfies a relationship of:

$$P\times\cos(\theta)-P\times\mu-Fr<0.$$

(Operation) Since the above formula takes a negative value even when torque is input from the outer cylinder part or the camshaft to the connection pin when the connection pin is at an arbitrary advanced angle position or retarded angle position and advance angle control or retard angle control is not performed, torque is never transmitted from the connection pin to one rotary drum or the other rotary drum, and the connection pin is locked to the arbitrary advanced angle position or retarded angle position to reach a self-locking state.

An engine valve controller according to a ninth aspect of the invention is the engine valve controller according to the third or seventh aspect of the invention in which a ring-shaped retainer is mounted between a rotary drum adjacent to the outer cylinder part of the rotary drums and the outer cylinder part, and in the retainer, a plurality of through-holes are formed dispersed along the circumferential direction, and in each through-hole, a rotor that is in contact with the rotary drum and the outer cylinder part is freely rotatably mounted.

(Operation) The ring-shaped retainer is mounted between the rotary drum adjacent to the outer cylinder part and the outer cylinder part, and in the through-hole formed in the retainer, a rotor that is in contact with the rotary drum and the outer cylinder part is freely rotatably mounted, so that even when a force resulting from a rotation of the rotary drum adjacent to the outer cylinder part acts on the outer cylinder part via the rotor, a frictional resistance between the rotary drum adjacent to the outer cylinder part and the outer cylinder part can be reduced by a rotation of the rotor, and consequently, required torque in operation of the rotary drum can be reduced.

Effects of the Invention

As is apparent from the above description, by the engine valve controller according to the first aspect of the invention, according to the position in the axial direction of the intermediate member, the phase between the sprocket on the outer periphery of the outer cylinder part and the camshaft can be variably adjusted, the intermediate member can be positioned at an advanced angle position or retarded angle position, and further, the power consumption can be reduced.

By the engine valve controller according to the second aspect of the invention, according to the position in the axial direction of the intermediate member, the phase between the sprocket on the outer periphery of the outer cylinder part and the camshaft can be variably adjusted, the intermediate member can be positioned at an advanced angle position or retarded angle position, and further, the power consumption can be reduced.

By the engine valve controller according to the third aspect of the invention, the intermediate member can be set to an arbitrary advanced angle or retarded angle position, and the power consumption can be reduced.

By the engine valve controller according to the fourth aspect of the invention, the intermediate member can be locked to an arbitrary advanced angle position or retarded angle position, and brought into a self-locking state.

By the engine valve controller according to the fifth aspect of the invention, once a phase angle between the sprocket on the outer periphery of the outer cylinder part and the camshaft is determined, the phase angle between the sprocket on the outer periphery of the outer cylinder part and the camshaft can be more reliably kept at the phase angle determined according to the position of the intermediate member, and the power consumption can be reduced.

By the engine valve controller according to the sixth aspect of the invention, according to the position of the connection pin in the axial direction of the inner cylinder part, the phase between the sprocket on the outer periphery of the outer cylinder part and the camshaft can be variably adjusted, the connection pin can be positioned at an advanced angle position or retarded angle position, and further, the power consumption can be reduced.

By the engine valve controller according to the seventh aspect of the invention, the connection pin can be set to an arbitrary advanced angle or retarded angle position, and the power consumption can be reduced.

By the engine valve controller according to the eighth aspect of the invention, the connection pin can be locked to an arbitrary advanced angle position or retarded angle position, and the connection pin can be brought into a self-locking state.

By the engine valve controller according to the ninth aspect of the invention, required torque in operation of the rotary drum can be reduced.

BEST MODE FOR CARRYING OUT THE INVENTION

Hereinafter, embodiments of the present invention will be described based on the drawings.

FIG. 1 is a longitudinal sectional view of an engine valve controller showing a first embodiment of the present invention, FIG. 2 is a front view of an outer cylinder part and a small-diameter outer cylinder part, FIG. 3(*a*) is a sectional view of an outer cylinder part, FIG. 3(*b*) is a back view of the outer cylinder part, FIG. 4(*a*) is a plan view of an inner cylinder part, FIG. 4(*b*) is an exploded view of an outer peripheral side of the inner cylinder part, FIG. 5(*a*) is a plan view of an intermediate member, FIG. 5(*b*) is a front view of the intermediate member, FIG. 5(*c*) is an exploded view of an outer peripheral side of the intermediate member, FIG. 6 is a view showing a state where a pin and a roller are fitted in the intermediate member, FIG. 7(*a*) is a sectional view of the pin, FIG. 7(*b*) is a plan view of the roller, FIG. 7(*c*) is a sectional view of the roller, FIG. 7(*d*) is a plan view of a roller pin, FIG. 8(*a*) is a back view of a cover, FIG. 8(*b*) is a sectional view along a line A-A of FIG. 8(*a*), FIG. 9(*a*) is a plan view of a front-side rotary drum, FIG. 9(*b*) is a front view of the front-side rotary drum, FIG. 9(*c*) is an exploded view of an outer peripheral side of the front-side rotary drum, FIG. 10(*a*) is a front view of a rear-side rotary drum, FIG. 10(*b*) is a sectional view of the rear-side rotary drum, FIG. 10(*c*) is an exploded view of an inner peripheral side of the rear-side rotary drum, FIG. 11(*a*) is an exploded view for explaining the relationship between the front-side rotary drum and rear-side rotary drum and the intermediate member, FIG. 11(*b*) is a view for explaining the rotational direction of the inner cylinder part, FIG. 12 is a longitudinal sectional view of an engine valve controller showing a second embodiment of the present invention, FIG. 13 is a longitudinal sectional view of an engine valve controller showing a third embodiment of the present invention, FIG. 14 is a longitudinal sectional view of the main part of an engine valve controller showing a fourth embodiment of the present invention, FIG. 15 is a back view of an outer cylinder part in the fourth embodiment, FIG. 16(*a*) is a view for explaining the relationship between the front-side rotary drum and the rear-side rotary drum in the fourth embodiment, FIG. 16(*b*) is an exploded view of an outer peripheral side of the front-side rotary drum in the fourth embodiment, FIG. 16(*c*) is an exploded view of an outer peripheral side of the rear-side rotary drum in the fourth embodiment, FIG. 17 is a longitudinal sectional view of the main part of an engine valve controller showing a fifth embodiment of the present invention, FIG. 18 is a front view of a retainer in the fifth embodiment, and FIG. 19 is an exploded view for explaining the relationship between the rear-side rotary drum and roller and the outer cylinder part in the fifth embodiment.

In these figures, the engine valve controller according to the present invention is used under an engine oil atmosphere in a form that this is installed in, for example, an automobile engine, and is configured as a device that transmits a rotation of a crankshaft so that intake and exhaust valves open and close in synchronization with the rotation of the crankshaft, and changes the timing of opening and closing of the intake valve or the exhaust valve of the engine depending on operating conditions such as a load and a speed of the engine.

Concretely, the engine valve controller includes, as shown in FIG. 1, an annular outer cylinder part 10 to which a driving force of a crankshaft of the engine is transmitted, an annular inner cylinder part 12 disposed at an inner peripheral side of the outer cylinder part 10 coaxially with the outer cylinder part 10 and rotatably relative to the outer cylinder part 10, and coaxially connected to a camshaft 2 that opens and closes the intake valve or the exhaust valve of the engine, an intermediate member 14 formed in a circular cylindrical shape, and disposed on the outer periphery of the inner cylinder part 12 freely movably along the axial direction of the inner cylinder part 12, a position control mechanism 16 that controls the position in the axial direction of the intermediate member 14 according to an operation condition of the engine, and a phase adjustment mechanism 18 that variably adjusts the phase between a sprocket 24 on the outer periphery of the outer cylinder part 10 and the camshaft 2 according to a position in the axial direction of the intermediate member 14.

One axial end side of the camshaft 2 is fitted to an inner peripheral side of the inner cylinder part 12, and to this one axial end side of the camshaft 2, a cam bolt 20 is tightened. The cam bolt 20 is fixed to one axial end side of the inner cylinder part 12 via a stopper 22. The stopper 22 is fixed to a one axial end-side outer peripheral surface of the inner cylinder part 12.

The outer cylinder part 10, as shown in FIG. 2 and FIG. 3, is formed as a cylinder body of a drive shaft side with a plurality of sprockets 24 arranged at an outer peripheral side, and structured so that, to the sprocket 24, a driving force of the crankshaft of the engine is transmitted via a chain. The outer cylinder part 10, when the driving force of the crankshaft of the engine is transmitted to the sprocket 24 via the chain, rotates in synchronization with the crankshaft, and transmits a driving force resulting from this rotation to the inner cylinder part 12 via the phase adjustment mechanism 18.

At the inner peripheral side of the outer cylinder part 10, a through-hole 26 to insert therethrough the inner cylinder part 12 is formed, and as a component of the phase adjustment mechanism 18, a pair of connection grooves 28 connecting to an edge of the through-hole 26 are formed opposed to each other along the axial direction of the outer cylinder part 10. Each connection groove 28, as a connection portion with the intermediate member 14, is formed with a substantially rectangular shape in section. On a head H side of the outer cylinder part 10, a small-diameter outer cylinder part 30 is arranged in parallel adjacent to the outer cylinder part 10, and the small-diameter outer cylinder part 30 is disposed on the outer periphery of the inner cylinder part 12, and fixed to the outer cylinder part 10 by a bolt 32. This small-diameter outer cylinder part 30 includes a plurality of sprockets 34 at its outer peripheral side, and when a driving force of the crankshaft of the engine is transmitted to the sprocket 34 via a chain, rotates in synchronization with the crankshaft.

The inner cylinder part 12 is formed as a cylinder body to be connected to the camshaft 2, and as shown in FIG. 4, at the outer peripheral side of the inner cylinder part 12, a connection portion 36, a flange portion 38, a large-diameter portion 40, and a small-diameter portion 42 are formed from the head H side, and a cam bolt insertion hole 44 and a camshaft fitting hole 46 are formed at the inner peripheral side (refer to FIG. 1). The connection portion 36 is connected with an axial end portion side of the camshaft 2, and the flange portion 38 is inserted in an inner peripheral-side step portion of the small-diameter outer cylinder part 30. On the outer periphery of the large-diameter portion 40, as a component of the phase adjustment mechanism 18, a pair of guide grooves 48 and 50 are formed spirally. The guide groove 48, 50 is formed ranging from a position corresponding to the most advanced angle phase to a position corresponding to the most retarded angle phase.

The intermediate member 14, as shown in FIG. 5, is formed as a cylinder body having a small-diameter portion 52 and a large-diameter portion 54, and disposed at an outer peripheral side of the large-diameter portion 40 of the inner cylinder part 12, freely movably along the axial direction of the inner cylinder part 12 (refer to FIG. 1 and FIG. 4). At one axial end side of the small-diameter portion 52 of the intermediate member 14, a pair of projections 56 are integrally formed. Each projection 56, as a connection portion connectable with the connection groove 28 of the outer cylinder part 10, is formed in a substantially rectangular shape. Each projection 56 is inserted in the connection groove 28 of the outer cylinder part 10 freely slidably along the axial direction of the outer cylinder part 10.

More specifically, the intermediate member 14 is connected at its part (projection 56) to the outer cylinder part 10 freely slidably along the axial direction of the outer cylinder part 10, so as to rotate along with the outer cylinder part 10. The large-diameter portion 54 of the intermediate member 14 includes guides 58, 60, 62, and 64 formed in substantially triangular shapes along the circumferential direction, the guides 58 to 64 are disposed so as to divide a region at an outer peripheral side of the small-diameter portion 52 into about four parts, and a recess portion 66, 68 is formed at a part of the guide 60, 64.

Each recess portion 66, 68 is formed with a pin insertion hole 70, 72. In the pin insertion hole 70, 72, as shown in FIG. 6 and FIG. 7, a pin 74 formed in a circular cylindrical shape is inserted. The pins 74 are inserted in the pin insertion holes 70, 72 in a manner protruding at their tip portions to the inner peripheral side of the intermediate member 14, and the protruded tip portions are mounted in the guide grooves 48, 50 of the outer peripheral side of the inner cylinder part 12, respectively. At this time, each pin 74 moves within the guide groove 48, 50 according to an axial displacement of the intermediate member 14, so as to apply a force resulting from the axial displacement of the intermediate member 14 to the guide groove 48, 50 as a force for a circumferential displacement of the inner cylinder part 12.

In each recess portion 66, 68, a roller 76 formed in a substantially bowl shape is mounted. In a bottom portion of the roller 76, a through-hole 78 is formed, and in the through-hole 78, a roller pin 80 insertable in the pin 74 is inserted. When the roller pin 80 is inserted in the through-hole 78 of the roller 76 mounted in each recess portion 66, 68, the roller pin 80 excluding a head portion 82 is inserted in the pin 74, and the head portion 82 is mounted on the bottom portion of the roller 76. In this case, the roller 76 is mounted in each recess portion 66, 68 freely rotatably around the roller pin 80.

Each of the guides 58 to 64 is formed as a protruding portion to guide movement of a front-side rotary drum 84 and a rear-side rotary drum 86. One sidewall of each of the guides 58 to 64 is linearly formed as a positioning ramp (first ramp) 88, 90, 92, 94 in a direction inclined with respect to a line perpendicular to the central axis of the intermediate member 14, and the other sidewall is linearly formed in a direction inclined with respect to a line perpendicular to the central axis of the intermediate member 14 as a positioning ramp (second ramp) 96, 98, 100, 102 which is out of phase in the circumferential direction with the ramp 88, 90, 92, 94 (refer to FIG. 5(*c*)). The ramp 88, 90 and the ramp 92, 94 are formed in a shape where the inclination gradually changes every 180 degrees, and the ramp 96, 98 and the ramp 100, 102 are formed in a shape where the inclination gradually changes every 180 degrees. In addition, the ramp 88 and the ramp 90 in the guide 58 are mutually shifted in phase by 90 degrees.

The position control mechanism 16 for controlling the position (position in the axial direction of the inner cylinder part 12) of the intermediate member 14 includes the rotary drums 84, 86 formed in ring shapes and electromagnetic clutches 104, 106 formed in ring shapes, and the rotary drum 84 and the rotary drum 86 are, with the intermediate member 14 interposed therebetween, disposed separated on both sides of the intermediate member 14 (refer to FIG. 1). For the electromagnetic clutch 104, 106, as shown in FIG. 8, a solenoid 108, 110 is connected to a control circuit (not shown) via a lead wire 112, 114, and a pin 116, 118 is inserted in a hole 122, 124 of a cover 120, and fixed to stop whirling. The control circuit detects an operation condition of the engine, outputs a control signal according to the operation condition of the engine to the electromagnetic clutch 104, 106 or the like, so as to control on and off of the electromagnetic clutch 104, 106. In addition, the cover 120 is fixed to an engine chain case 126.

The rotary drum 84, as shown in FIG. 9, includes a small-diameter portion 130 and a large-diameter portion 132 formed in substantially circular cylindrical shapes, and is freely rotatably disposed at the outer peripheral side of the inner cylinder part 12. At a head H side of the small-diameter portion 130, ramps 134, 136 by cutting out are linearly formed in a direction inclined with respect to a line perpendicular to the central axis of the rotary drum 84, and the ramps 134, 136 are formed in a shape where the inclination gradually changes every 180 degrees. This small-diameter portion 130 is mounted on a crank pulley CP side of the small-diameter portion 52 of the intermediate member 14, disposed so that the ramps 134, 136 (third ramps) are engaged with the ramps (first ramps) 88, 90, 92, 94 of the intermediate member 14, and disposed so as to contact the roller 76. The large-diameter portion 132 is disposed at a position to contact the stopper 22, and by contact between the large-diameter portion 132 and the stopper 22, a movement of the rotary drum 84 toward the crank pulley CP is prevented.

The rotary drum 86, as shown in FIG. 10, includes a small-diameter portion 138 and a large-diameter portion 140 formed in substantially circular cylindrical shapes, and is freely rotatably disposed at the outer peripheral side of the intermediate member 14. At an inner peripheral side of the small-diameter portion 138 and the large-diameter portion 140, ramps 142, 144 serving as guide grooves are linearly formed in a direction inclined with respect to a line perpendicular to the central axis of the rotary drum 86, and the ramps 142, 144 are formed in a shape where the inclination gradually changes every 180 degrees. This small-diameter portion 138 is mounted in an annular recess portion 10*a* of the outer cylinder part 10, and by contact with the annular recess portion 10*a*, a movement of the rotary drum 86 toward the head H is prevented. The large-diameter portion 140 is mounted on the head H side of the small-diameter portion 52 of the intermediate member 14, disposed so that the ramps (fourth ramps) 142, 144 are engaged with the ramps (second ramps) 96, 98, 100, 102 of the intermediate member 14, and disposed so as to contact the roller 76.

The position in the axial direction of the rotary drum 84, 86 is controlled by an on and off state of the electromagnetic clutch 104, 106, and the electromagnetic clutch 104 is turned on, under advance angle control, when the solenoid 108 is supplied with current, and is turned off in other cases. The electromagnetic clutch 106 is turned on, under retard angle control, when the solenoid 110 is supplied with current, and is turned off in other cases. When the solenoid 108 or 110 is supplied with current, the intermediate member 14 moves to an advanced angle position or retarded angle position as a result of a movement in the axial direction of the rotary drum 84 or 86.

Specifically, when the solenoid 108 and the solenoid 110 are in a non-current carrying state, the rotary drum 84, 86 rotates along with the intermediate member 14 without imparting a rotating force to the intermediate member 14, and for example, in the case of controlling the opening and closing timing of the intake valve, during idling, the intermediate member 14 is at a most retarded angle position. Thereafter, for the purpose of advance angle control, when only the solenoid 108 is supplied with current, as shown in FIG. 11(*a*), the rotary drum 84 rotates in the arrow X direction, and a rotating force of the rotary drum 84 is imparted from the ramps 134, 136 of the rotary drum 84 to the ramps 88, 90, 92, 94 of the intermediate member 14 and the roller 76.

Accordingly, as a result of the pin 74 mounted to the intermediate member 14 moving along the guide groove 48, 50 of the inner cylinder part 12 and the projection 56 of the intermediate member 14 moving along the connection groove 28 of the outer cylinder part 10, the inner cylinder part 12 rotates in the arrow Y direction (refer to FIG. 11(*b*)), and the intermediate member 14 moves toward the head H (toward the camshaft or to an advanced angle side) along the axial direction of the inner cylinder part 12. In the course of the intermediate member 14 moving from the most retarded angle position to the most advanced angle position, when the solenoid 108 is brought into a non-current carrying state at an arbitrary timing, the electromagnetic clutch 104 is turned off, and the intermediate member 14 is positioned at an arbitrary advanced angle position.

At this time, as a result of a movement of the intermediate member 14, to the outer cylinder part 10 and the inner cylinder part 12, circumferential displacements in mutually opposite directions, which are circumferential displacements different in size according to the position in the axial direction of the intermediate member 14, are applied, the outer cylinder part 10 rotates counterclockwise in relation to the crank pulley CP side, while the inner cylinder part 10 rotates clockwise (arrow Y direction) in relation to the crank pulley CP side, and the phase between the outer cylinder part 10 and the camshaft 2 is adjusted to the advanced angle side.

On the other hand, while the intermediate member 14 is at the most advanced angle position, for the purpose of retard angle control, when only the solenoid 110 is supplied with current to turn on the electromagnetic clutch 106, the rotary drum 86 rotates in the arrow X direction (refer to FIG. 11(*a*)), and a rotating force of the rotary drum 86 is imparted from the ramps 142, 144 of the rotary drum 86 to the ramps 96, 98, 100, 102 of the intermediate member 14 and the roller 76. Accordingly, as a result of the pin 74 on the intermediate member 14 moving along the guide groove 48, 50 of the inner cylinder part 12 and the projection 56 of the intermediate member 14 moving along the connection groove 28 of the outer cylinder part 10, the inner cylinder part 12 rotates in the arrow Z direction (refer to FIG. 11(*b*)), and the intermediate member 14 moves toward the crank pulley CP (to a retarded angle side) along the axial direction of the inner cylinder part 12. In the course of the intermediate member 14 moving from the most advanced angle position to the most retarded angle position, when the solenoid 110 is brought into a non-current carrying state at an arbitrary timing, the electromagnetic clutch 106 is turned off, and the intermediate member 14 is positioned at an arbitrary retarded angle position.

At this time, as a result of a movement of the intermediate member 14, to the outer cylinder part 10 and the inner cylinder part 12, circumferential displacements in mutually opposite directions, which are circumferential displacements different in size according to the position in the axial direction of the intermediate member 14, are applied, the outer cylinder part 10 rotates clockwise in relation to the crank pulley CP side, while the inner cylinder part 12 rotates counterclockwise (arrow Z direction) in relation to the crank pulley CP side, and the phase between the outer cylinder part 10 and the camshaft 2 is adjusted to the retarded angle side.

While the intermediate member 14 is at an arbitrary advanced angle position or retarded angle position, when the solenoids 108, 110 are respectively brought into a non-current carrying state, the rotary drums 84, 86 rotate along with the intermediate member 14 without imparting a rotating force to the intermediate member 14. Thereafter, when advance angle control is performed, by supplying the solenoid 108 with current, the intermediate member 14 can be positioned at another advanced angle position, and when retard angle control is performed, by supplying the solenoid 110 with current, the intermediate member 14 can be positioned at another retarded angle position, On the other hand, when the solenoids 108, 110 are respectively brought into a non-current carrying state, and the intermediate member 14 is positioned at an arbitrary advanced angle position or retarded angle position, the intermediate member 14 is self-locked to that position.

More specifically, the ramps 134, 136 of the rotary drum 84 and the ramps 88, 90, 92, 94 of the intermediate member 14, as shown in FIG. 11, have inclination angles (angles of inclination with respect to a line perpendicular to the central axis of the rotary drum 84) θ, which are angles not more than an angle of friction and more than 0 degrees, and set to values satisfying the following formula (1).

$$P\times\cos(\theta)-P\times\mu-Fr<0 \quad (1)$$

Here, P represents a force acting on the rotary drum 84, 86 from the roller 76, which is a force to be parallel with the central axis of the rotary drum 84, 86, Fr represents journal friction acting in the circumferential direction of the rotary drum 84, 86, and μ represents a coefficient of friction between the rotary drum 84 or rotary drum 86 and the intermediate member 14. In addition, the inclination angles θ between the ramps 142, 144 of the rotary drum 86 and the ramps 96, 98, 100, 102 of the intermediate member 14 are also set to values satisfying the formula (1).

If the inclination angles θ of the ramps 134, 136 of the rotary drum 84 and the ramps 88, 90, 92, 94 of the intermediate member 14 are set to values satisfying the formula (1), since the formula (1) takes negative values even when torque is input to the intermediate member 14 from the outer cylinder part 10 or the camshaft 2 when the intermediate member 14 is at an arbitrary advanced angle position or retarded angle position and advance angle control or retard angle control is not performed, the roller 76 is in a non-moving (non-rotating) state, torque is not transmitted from the roller 76 to the rotary drums 84, 86, and the intermediate member 14 is locked to the arbitrary advanced angle position or retarded angle position to reach a self-locking state.

In the present embodiment, in the course of the intermediate member 14 moving to an advanced angle position or retarded angle position as a result of supplying current to the solenoid 108 or the solenoid 110, in response to an axial displacement resulting from the movement of the intermediate member 14, the projection 56 moves along the connection groove 28 of the outer cylinder part 10, and the pin 74 moves along the guide groove 48, 50 of the inner cylinder part 12, so that to the inner cylinder part 12, a circumferential displacement according to the position in the axial direction of the intermediate member 14 is applied, and the phase between the sprocket 24 on the outer periphery of the outer cylinder part 10 and the camshaft 2 is variably adjusted as a result of the circumferential displacement of the inner cylinder part 12 (rotation of the inner cylinder part 12).

On the other hand, when the intermediate member 14 has been set to an advanced angle position or retarded angle position as a result of stopping supplying current to the solenoid 108 and the solenoid 110, and a phase angle between the outer cylinder part 10 and the camshaft 2 has been determined, to a torque input from the sprocket 24 on the outer periphery of the outer cylinder part 10 or the camshaft 2, the roller 76 is in a non-rotating state, an axial movement of the intermediate member 14 is stopped, and transmission of a torque input from the intermediate member 14 to the rotary drum 84 or 86 is prevented, so that the drive shaft side including the outer cylinder part 10 and the driven shaft side including the inner cylinder part 12 irreversibly transmit torque therebetween to reach a self-locking state.

According to the present embodiment, in the course of the intermediate member 14 moving to an advanced angle position or retarded angle position as a result of supplying current to the solenoid 108 or the solenoid 110, in response to an axial displacement resulting from the movement of the intermediate member 14, the projection 56 is made to move along the connection groove 28 of the outer cylinder part 10 and the pin 74 is made to move along the guide groove 48, 50 of the inner cylinder part 12 so as to convert the axial displacement of the intermediate member 14 to a circumferential displacement of the inner cylinder part 12, the phase between the sprocket 24 on the outer periphery of the outer cylinder part 10 and the camshaft 2 can be variably adjusted according to the position of the intermediate member 14.

Moreover, according to the present embodiment, once a phase angle between the sprocket 24 on the outer periphery of the outer cylinder part 10 and the camshaft 2 is determined, even when a reaction force is received from the camshaft 2, the drive shaft side including the outer cylinder part 10 and the driven shaft side including the inner cylinder part 12 reach a self-locking state without consuming power, the phase angle between the sprocket 24 on the outer periphery of the outer cylinder part 10 and the camshaft 2 can be kept at the phase angle determined according to the position of the intermediate member 14, and the power consumption can be reduced.

Further, according to the present embodiment, the position control mechanism 16 and the phase adjustment mechanism 18 can be composed of a smaller number of components, which can contribute to a cost reduction.

Moreover, according to the present embodiment, it is not necessary to move the intermediate member 14 against the elasticity of a return spring, and the intermediate member 14 can be moved by only supplying the solenoid 108 or the solenoid 110 with current, so that the power consumption can be reduced from that when a return spring is used.

Next, a second embodiment of the present invention will be described according to FIG. 12. For the present embodiment, a ball (hard ball) 146 is used in place of the pin 74, the ball 146 is inserted in the pin insertion hole 70, 72 of the intermediate member 14 and fixed, and a part of the ball 146 is protruded from the inner periphery of the intermediate member 14 toward the outer periphery of the inner cylinder part 12, so that the ball 146 moves within the guide groove 48, 50 according to an axial displacement of the intermediate member 14, so as to impart a force resulting from the axial displacement of the intermediate member 14 to the guide groove 48, 50 as a force for a circumferential displacement of the inner cylinder part 12, and the present embodiment is the same as the first embodiment in other aspects of the configuration.

In this case, when the intermediate member 14 is between the most advanced angle position and the most retarded angle position, with an axial displacement of the intermediate member 14, the ball 146 moves within the guide groove 48, 50 according to an axial displacement of the intermediate member 14 and the projection 56 of the intermediate member 14 moves along the connection groove 28 of the outer cylinder part 10, and a force resulting from the axial displacement of the intermediate member 14 is imparted to the guide groove 48, 50 as a force for a circumferential displacement of the inner cylinder part 12. When the inner cylinder part 12 is displaced in the circumferential direction as a result of the axial displacement of the intermediate member 14, and according to the position in the axial direction of the intermediate member 14, the phase between the sprocket 24 on the outer periphery of the outer cylinder part 10 and the camshaft 2 can be variably adjusted, and the intermediate member 14 can be positioned at an advanced angle position or retarded angle position.

According to the present embodiment, in the course of the intermediate member 14 moving to an advanced angle position or retarded angle position as a result of supplying current to the solenoid 108 or the solenoid 110, in response to an axial displacement resulting from the movement of the intermediate member 14, the ball 146 moves along the guide groove 48, 50 of the inner cylinder part 12, so that to the outer cylinder part 10 and the inner cylinder part 12, circumferential displacements in mutually opposite directions, which are circumferential displacements different in size according to the position in the axial direction of the intermediate member 14, are applied, and the phase between sprocket 24 on the outer periphery of the outer cylinder part 10 and the camshaft 2 is variably adjusted.

On the other hand, when the intermediate member 14 has been set to an advanced angle position or retarded angle position as a result of stopping supplying current to the solenoid 108 and the solenoid 110, and a phase angle between the outer cylinder part 10 and the camshaft 2 has been determined, to a torque input from the outer cylinder part 10 or the camshaft 2, an axial movement of the intermediate member 14 is stopped, and transmission of a torque input from the intermediate member 14 to the rotary drum 84 or 86 is prevented, so that the drive shaft side including the outer cylinder part 10 and the driven shaft side including the inner cylinder part 12 irreversibly transmit torque therebetween to reach a self-locking state.

More specifically, once a phase angle between the sprocket 24 on the outer periphery of the outer cylinder part 10 and the camshaft 2 is determined, even when a reaction force is received from the camshaft 2, the drive shaft side including the outer cylinder part 10 and the driven shaft side including the inner cylinder part 12 reach a self-locking state without consuming power, the phase angle between the sprocket 24 on the outer periphery of the outer cylinder part 10 and the camshaft 2 can be kept at the phase angle determined according to the position of the intermediate member 14, and the power consumption can be reduced.

Next, a third embodiment of the present invention will be described according to FIG. 13. For the present embodiment, between the stopper 22 and the rotary drum 84 of the outer peripheral side of the inner cylinder part 12, a disc spring 148 being an annular-shaped elastic body is mounted, so as to apply an elastic force of the disc spring 148 to the rotary drum 84, 86, and the present embodiment is the same as the first embodiment or the second embodiment in other aspects of the configuration.

The elastic force of the disc spring 148, which is a force along the axial direction of the inner cylinder part 12, acts so as to press the rotary drum 84, 86 toward the head H (camshaft). Therefore, even when there is a torque input from the sprocket 24 on the outer periphery of the outer cylinder part 10 or the camshaft 2 to the intermediate member 14 after the intermediate member 14 is set to an advanced angle position or retarded angle position as a result of stopping supplying current to the solenoid 108 and the solenoid 110 and a phase angle between the sprocket 24 on the outer periphery of the outer cylinder part 10 and the camshaft 2 is determined, a movement of the intermediate member 14 to the crank pulley CP due to this torque input can be prevented.

More specifically, once a phase angle between the sprocket 24 on the outer periphery of the outer cylinder part 10 and the camshaft 2 is determined, even when a reaction force is received from the camshaft 2, the drive shaft side including the outer cylinder part 10 and the driven shaft side including the inner cylinder part 12 can be more reliably brought into a self-locking state without consuming power, the phase angle between the sprocket 24 on the outer periphery of the outer cylinder part 10 and the camshaft 2 can be more reliably kept at the phase angle determined according to the position of the intermediate member 14, and the power consumption can be reduced.

According to the present embodiment, the same effects as those of the first embodiment or the second embodiment can be provided, and once a phase angle between the sprocket 24 on the outer periphery of the outer cylinder part 10 and the camshaft 2 is determined, even when a reaction force is received from the camshaft 2, the drive shaft side including the outer cylinder part 10 and the driven shaft side including the inner cylinder part 12 can be more reliably brought into a self-locking state without consuming power, the phase angle between the sprocket 24 on the outer periphery of the outer cylinder part 10 and the camshaft 2 can be more reliably kept at the phase angle determined according to the position of the intermediate member 14, and the power consumption can be reduced.

Next, a fourth embodiment of the present invention will be described according to FIG. 14 to FIG. 16. For the present embodiment, an outer cylinder part 150 is used in place of the outer cylinder part 10, rotary drums 152, 154 are used in place of the rotary drums 84, 86, electromagnetic clutches 156, 158 are used in place of the electromagnetic clutches 104, 106, a connection pin 160 is used in place of the intermediate member 14, a position control mechanism 16A is used in place of the position control mechanism 16, and a phase adjustment mechanism 18A is used in place of the phase adjustment mechanism 18, and the present embodiment is the same as the first embodiment in other aspects of the configuration.

Concretely, the outer cylinder part 150, as shown in FIG. 14 and FIG. 15, is formed, as a cylinder body of a drive shaft side, longer in axial length than the outer cylinder part 10 and with a plurality of sprockets 162 arranged at a central portion of an outer peripheral side, and structured so that, to the sprocket 162, a driving force of the crankshaft of the engine is transmitted via a chain. The outer cylinder part 150, when the driving force of the crankshaft of the engine is transmitted to the sprocket 162 via the chain, rotates in synchronization with the crankshaft, and transmits a driving force resulting from this rotation to the inner cylinder part 12 via the phase adjustment mechanism 18A.

At the inner peripheral side of the outer cylinder part 150, a through-hole 164 to insert therethrough the inner cylinder part 12 and the rotary drum 152, 154 is formed, and as a component of the phase adjustment mechanism 18A, a pair of guide grooves 166 connecting to an edge of the through-hole 164 are formed opposed to each other. Each guide groove 166, as a connection portion with the connection pin 160, is formed with a substantially rectangular shape in section, and in order to guide a movement of the connection pin 160, formed along the axial direction of the outer cylinder part 150 ranging from a position corresponding to the most advanced angle phase to a position corresponding to the most retarded angle phase. On a head H side of the outer cylinder part 150, a small-diameter outer cylinder part 30 is arranged in parallel adjacent to the outer cylinder part 150, and the small-diameter outer cylinder part 30 is disposed on the outer periphery of the inner cylinder part 12, and fixed to the outer cylinder part 150 by a bolt 32.

A pair of connection pins 160 are, as connection members to connect the outer cylinder part 150 and the inner cylinder part 12, each formed in a substantially columnar shape, one longitudinal (axial) end side of which penetrates through the rotary drum 152, 154, and is mounted in the guide groove (first guide groove) 48, 50 of the inner cylinder part 12, and the other end side of which penetrates through the rotary drum 152, 154, and is mounted in the guide groove (second guide groove) 166 of the outer cylinder part 150. Each connection pin 160 is controlled with respect to the position in the axial direction of the inner cylinder part 12 by the position control mechanism 16A, and when each connection pin 160 is displaced by the position control mechanism 16A along the axial direction of the inner cylinder part 12, one end side of each connection pin 160 moves along the guide groove 48, 50 of the inner cylinder part 12, and the other end side of each connection pin 160 moves along the guide groove 166 of the outer cylinder part 150. At this time, each connection pin 160 is structured so as to apply a force resulting from the axial displacement along the axial direction of the inner cylinder part 12 to the guide groove 48, 50 as a force for a circumferential displacement of the inner cylinder part 12.

The position control mechanism 16A for controlling the position of each connection pin 160 includes the rotary drums 152, 154 formed in ring shapes and electromagnetic clutches 156, 158 formed in ring shapes, and the rotary drum 152 and the rotary drum 154 are, with the rotary drum 152 located inside, disposed overlaid between the inner cylinder part 12 and the outer cylinder part 150. The electromagnetic clutch 156, 158, for which a solenoid 168, 170 is connected to a control circuit (not shown), is on/off-controlled by a control signal from the control circuit.

The rotary drum 152 is formed in a substantially circular cylindrical shape, and is freely rotatably disposed at the outer peripheral side of the inner cylinder part 12. In this rotary drum 152, as shown in FIG. 16, a guide hole (first guide hole) 172 to insert therethrough the connection pin 160 and to guide a movement of the connection pin 160 is formed in a direction inclined with respect to a line perpendicular to the central axis of the rotary drum 152 and along the circumferential direction. Semicircular portions 174, 176 are formed on both longitudinal sides of the guide hole 172, and between the semicircular portion 174 and the semicircular portion 176, a pair of ramps (first ramps) 178, 180 are linearly formed opposed to each other. The ramps 178, 180 are, as a pair of edges along the longitudinal direction of the guide hole 172, linearly formed in a direction inclined with respect to a line perpendicular to the central axis of the rotary drum 152.

The rotary drum 154 is formed in a substantially circular cylindrical shape, and is freely rotatably disposed at the outer peripheral side of the rotary drum 152. In this rotary drum 154, as shown in FIG. 16, a guide hole (second guide hole) 182 to insert therethrough the connection pin 160 is inserted and to guide a movement of the connection pin 160 is formed in a direction inclined in the opposite direction to the guide hole 172 with respect to a line perpendicular to the central axis of the rotary drum 154 and along the circumferential direction. Semicircular portions 184, 186 are formed on both longitudinal sides of the guide hole 182, and between the semicircular portion 184 and the semicircular portion 186, ramps (second ramps) 188, 190 are linearly formed opposed to each other. The ramps 188, 190 are, as a pair of edges along the longitudinal direction of the guide hole 182, linearly formed along the longitudinal direction in a direction inclined with respect to a line perpendicular to the central axis of the rotary drum 154.

The position in the axial direction of the rotary drum 152, 154 is controlled by an on and off state of the electromagnetic clutch 156, 158, and the electromagnetic clutch 156 is turned on, under advance angle control, when the solenoid 168 is supplied with current, and is turned off in other cases. The electromagnetic clutch 158 is turned on, under retard angle control, when the solenoid 170 is supplied with current, and is turned off in other cases. When the solenoid 168 or 170 is supplied with current, each connection pin 160 moves to an advanced angle position or retarded angle position as a result of a movement in the axial direction of the rotary drum 152 or 154 (axial direction in the inner cylinder part 12).

Specifically, when the solenoid 168 and the solenoid 170 are in a non-current carrying state, the rotary drum 152, 154 rotates along with the outer cylinder part 150 and the inner cylinder part 12 without imparting a rotating force to each connection pin 160, and the position of each connection pin 160 is determined based on the position of the rotary drum 152, 154 at that time.

For example, in the case of controlling the opening and closing timing of the intake valve, during idling, each connection pin 160 is at a most retarded angle position. Thereafter, for the purpose of advance angle control, when only the solenoid 168 is supplied with current, the rotary drum 152 rotates in the arrow X direction, and a rotating force of the rotary drum 152 is imparted from the ramp 178 of the rotary drum 152 to each connection pin 160. Accordingly, each connection pin 160 moves along the guide hole 172 of the rotary drum 152 and the guide groove 48, 50 of the inner cylinder part 12, and moves toward the head H (toward the camshaft or to an advanced angle side) along the axial direction of the inner cylinder part 12. In the course of each connection pin 160 moving from the most retarded angle position to a most advanced angle position, when the solenoid 168 is brought into a non-current carrying state at an arbitrary timing, the electromagnetic clutch 156 is turned off, and each connection pin 160 is positioned at an arbitrary advanced angle position.

At this time, as a result of a movement of each connection pin 160, to the outer cylinder part 150 and the inner cylinder part 12, circumferential displacements in mutually opposite directions, which are circumferential displacements different in size according to the position in the axial direction of each connection pin 160, are applied, the outer cylinder part 150 rotates counterclockwise in relation to the crank pulley CP side, while the inner cylinder part 12 rotates clockwise in relation to the crank pulley CP side, and the phase between the sprocket 162 on the outer periphery of the outer cylinder part 150 and the camshaft 2 is adjusted to the advanced angle side.

On the other hand, while each connection pin 160 is at the most advanced angle position, for the purpose of retard angle control, when only the solenoid 170 is supplied with current to turn on the electromagnetic clutch 158, the rotary drum 154 rotates in the arrow X direction, and a rotating force of the rotary drum 154 is imparted from the ramp 190 of the rotary drum 154 to each connection pin 160. Accordingly, each connection pin 160 moves along the guide hole 182 of the rotary drum 154 and the guide groove 48, 50 of the inner cylinder part 12, and moves toward the crank pulley CP (in a direction to separate from the camshaft or to a retarded angle side) along the axial direction of the inner cylinder part 12. In the course of each connection pin 160 moving from the most advanced angle position to the most retarded angle position, when the solenoid 170 is brought into a non-current carrying state at an arbitrary timing, the electromagnetic clutch 158 is turned off, and each connection pin 160 is positioned at an arbitrary retarded angle position.

At this time, as a result of a movement of each connection pin 160, to the outer cylinder part 150 and the inner cylinder part 12, circumferential displacements in mutually opposite directions, which are circumferential displacements different in size according to the position in the axial direction of the inner cylinder part 12, are applied, the outer cylinder part 150 rotates clockwise in relation to the crank pulley CP side, while the inner cylinder part 12 rotates counterclockwise in relation to the crank pulley CP side, and the phase between the sprocket 162 on the outer periphery of the outer cylinder part 150 and the camshaft 2 is adjusted to the retarded angle side.

After each connection pin 160 is positioned at an arbitrary advanced angle position or retarded angle position, when advance angle control is performed, by supplying the solenoid 168 with current, each connection pin 160 can be positioned at another advanced angle position, and when retard angle control is performed, by supplying the solenoid 170 with current, each connection pin 160 can be positioned at another retarded angle position.

On the other hand, when the solenoids 168, 170 are respectively brought into a non-current carrying state, and each connection pin 160 is positioned at an arbitrary advanced angle position or retarded angle position, each connection pin 160 is self-locked to that position.

More specifically, the ramps 178, 180 of the rotary drum 152 and the ramps 188, 190 of the rotary drum 154, as shown in FIG. 16(*a*), have inclination angles (angles of inclination with respect to a line perpendicular to the central axis of the rotary drum 152, 154) θ, which are angles not more than an angle of friction and more than 0 degrees, and set to values satisfying the following formula (2).

$$P\times\cos(\theta)-P\times\mu Fr<0 \quad (2)$$

Here, P represents a force acting on the rotary drum 152, 154 from each connection pin 160, which is a force to be parallel with the central axis of the rotary drum 152, 154, Fr represents journal friction acting in the circumferential direction of the rotary drum 152, 154, and μ represents a coefficient of friction between the rotary drum 152 or rotary drum 154 and each connection pin 160.

If the inclination angles θ of the ramps 178, 180 of the rotary drum 152 and the ramps 188, 190 of the rotary drum 154 are set to values satisfying the formula (2), since the formula (2) takes negative values even when torque is input to each connection pin 160 from the sprocket 162 on the outer periphery of the outer cylinder part 150 or the camshaft 2 when each connection pin 160 is at an arbitrary advanced angle position or retarded angle position and advance angle control or retard angle control is not performed, torque is not transmitted from each connection pin 160 to the rotary drums 152, 154, and each connection pin 160 is locked to the arbitrary advanced angle position or retarded angle position to reach a self-locking state.

Further, on an axial central portion of each rotary drum 152, 154, tension of the chain connected to the sprocket 162 acts via the outer cylinder part 150, and each rotary drum 152, 154 is pressed by the chain tension toward the inner cylinder part 12, so that even when there is a torque input from the sprocket 162 on the outer periphery of the outer cylinder part 150 or the camshaft 2 to each connection pin 160 after each connection pin 160 is set to an advanced angle position or retarded angle position as a result of stopping supplying current to the solenoid 168 and the solenoid 170 and a phase angle between the sprocket 162 on the outer periphery of the outer cylinder part 150 and the camshaft 2 is determined, movement of each connection pin 160 to the crank pulley CP due to this torque input can be prevented.

More specifically, once a phase angle between the sprocket 162 on the outer periphery of the outer cylinder part 150 and the camshaft 2 is determined, even when a reaction force is received from the camshaft 2, the drive shaft side including the outer cylinder part 150 and the driven shaft side including the inner cylinder part 12 can be more reliably brought into a self-locking state without consuming power, the phase angle between the sprocket 162 on the outer periphery of the outer cylinder part 150 and the camshaft 2 can be more reliably kept at the phase angle determined according to the position of each connection pin 160, and the power consumption can be reduced.

According to the present embodiment, in the course of each connection pin 160 moving to an advanced angle position or retarded angle position as a result of supplying current to the solenoid 168 or the solenoid 170, each connection pin 160 moves along the guide groove 48, 50 of the inner cylinder part 12, the guide hole 172 of the rotary drum 152, and the guide hole 182 of the rotary drum 154, and when each connection pin 160 is displaced along the axial direction of the inner cylinder part 12, to the outer cylinder part 150 and the inner cylinder part 12, circumferential displacements in mutually opposite directions, which are circumferential displacements different in size according to the position of each connection pin 160 in the axial direction of the inner cylinder part 12, are applied, and the phase between sprocket 162 on the outer periphery of the outer cylinder part 150 and the camshaft 2 is variably adjusted.

Moreover, according to the present embodiment, once a phase angle between the sprocket 162 on the outer periphery of the outer cylinder part 150 and the camshaft 2 is determined, even when a reaction force is received from the camshaft 2, the drive shaft side including the outer cylinder part 150 and the driven shaft side including the inner cylinder part 12 can be more reliably brought into a self-locking state without consuming power, the phase angle between the sprocket 162 on the outer periphery of the outer cylinder part 150 and the camshaft 2 can be more reliably kept at the phase angle determined according to the position of each connection pin 160, and the power consumption can be reduced.

Further, according to the present embodiment, the position control mechanism 16A and the phase adjustment mechanism 18A can be composed of a smaller number of components, which can contribute to a cost reduction.

Moreover, according to the present embodiment, it is not necessary to move each connection pin 160 against the elasticity of a return spring, and each connection pin 160 can be moved by only supplying the solenoid 168 or the solenoid 170 with current, so that the power consumption can be reduced from that when a return spring is used.

Next, a fifth embodiment of the present invention will be described according to FIG. 17 to FIG. 19. For the present embodiment, between the rotary drum 86 adjacent to the outer cylinder part 10 and the outer cylinder part 10, a ring-shaped retainer 192 is mounted, and in the retainer 192, a plurality of through-holes 194 are formed dispersed along the circumferential direction, and in each through-hole 194, a roller 196 serving as a rotor being in contact with side surfaces of the rotary drum 86 and the outer cylinder part 10 is freely rotatably mounted, and the present embodiment is the same as the first embodiment in other aspects of the configuration. In addition, as the rotor, a ball may also be used in place of the roller 196.

According to the present embodiment, the ring-shaped retainer 192 is mounted between the rotary drum 86 and the outer cylinder part 10, and in each through-hole 194 formed in the retainer 192, the roller 196 being in contact with the rotary drum 86 and the outer cylinder part 10 is freely rotatably mounted, so that even when a force resulting from a rotation of the rotary drum 86 acts on the outer cylinder part 10 via the roller 196, a frictional resistance between the rotary drum 86 and the outer cylinder part 10 can be reduced by a rotation of the roller 196, and consequently, required torque in operation of the rotary drum 86 can be reduced.

Although a description has been given of the configuration according to the present embodiment applied to the first embodiment, the configuration according to the present embodiment can also be applied to the second embodiment to the fourth embodiment.

DESCRIPTION OF REFERENCE NUMERALS

Figure 1:
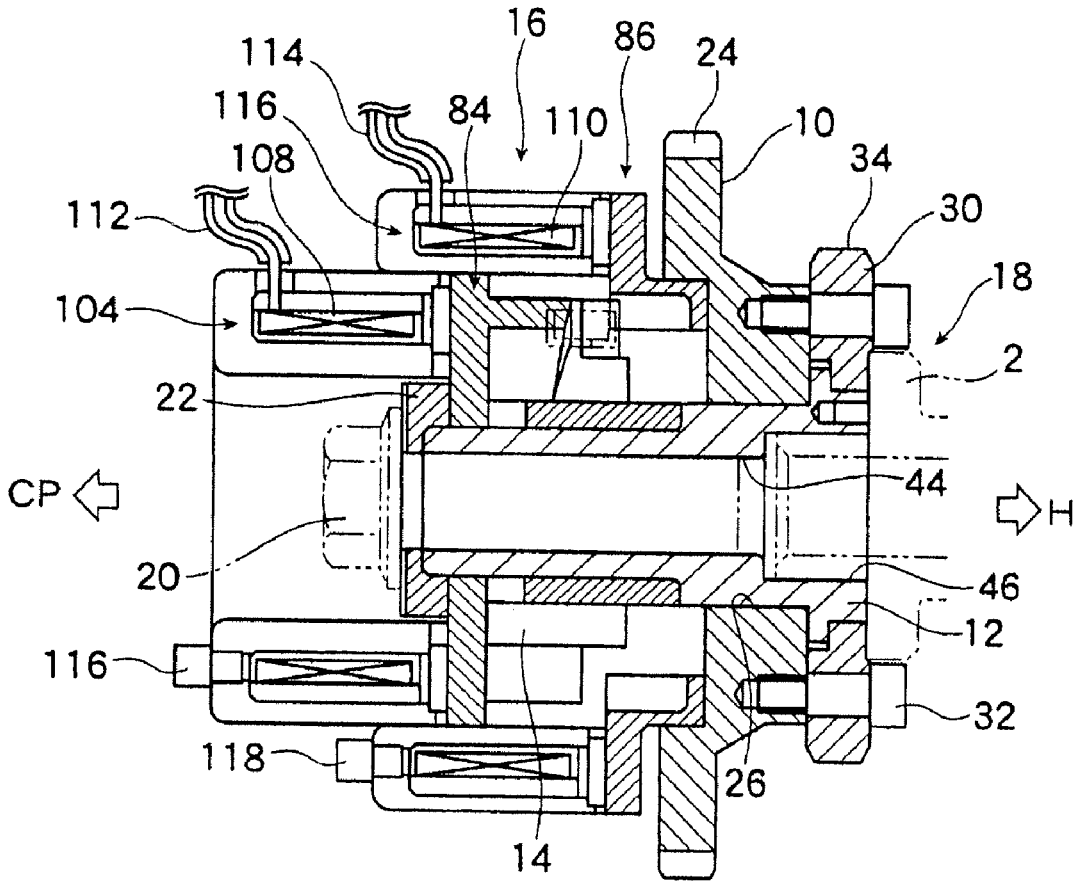
FIG. 1 is a longitudinal sectional view of an engine valve controller showing a first embodiment of the present invention.
Figure 2:
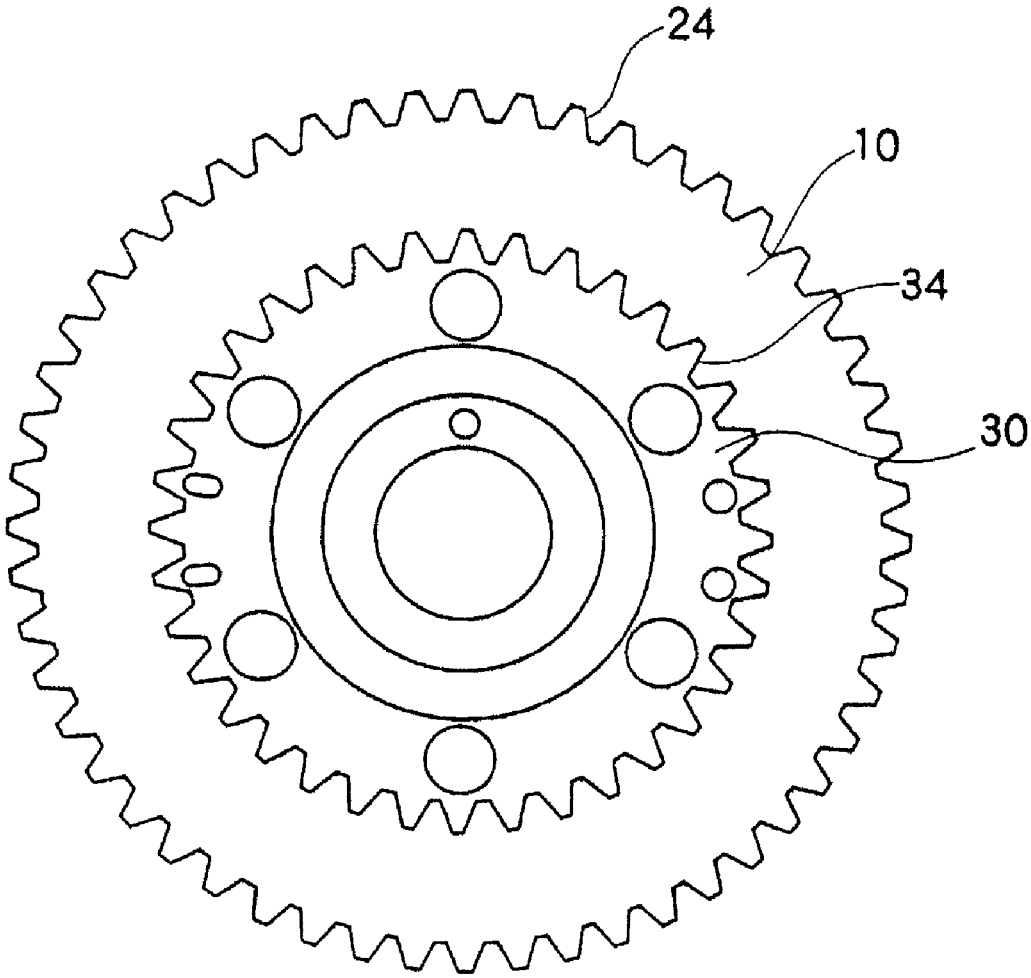
FIG. 2 is a front view of an outer cylinder part and a small-diameter outer cylinder part.
Figure 3B:
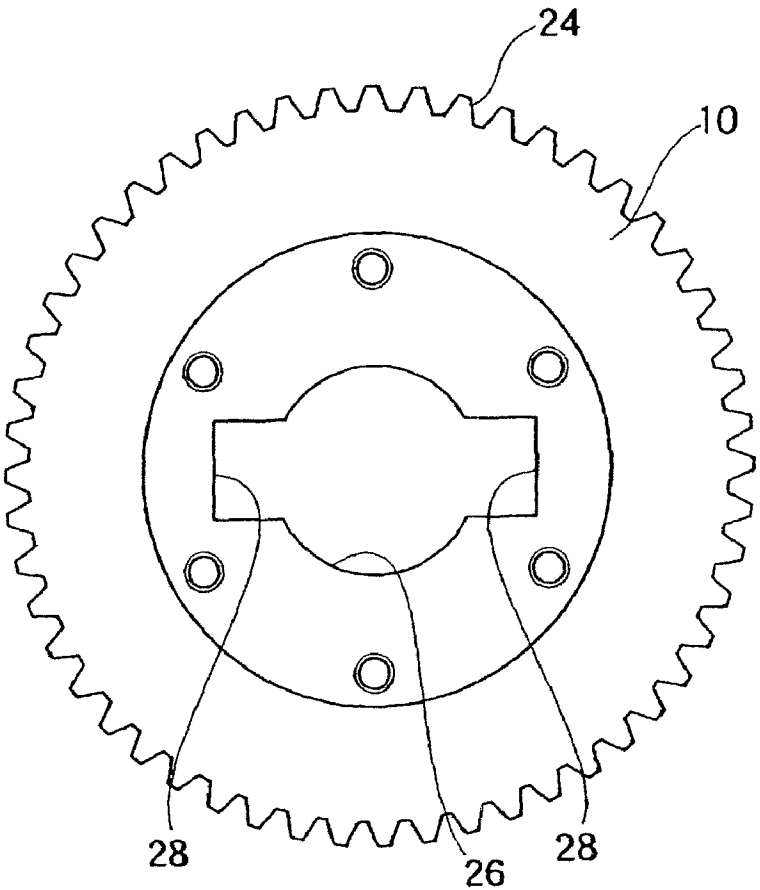
FIG. 3(*a*) is a sectional view of an outer cylinder part, and FIG. 3(*b*) is a back view of the outer cylinder part.
Figure 3A:
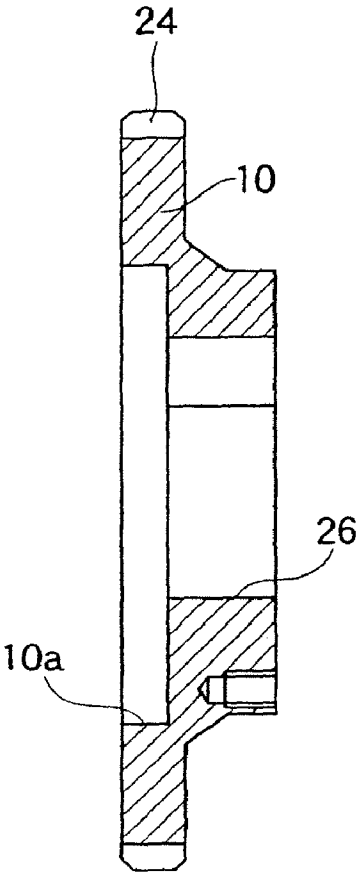
Figure 4A:
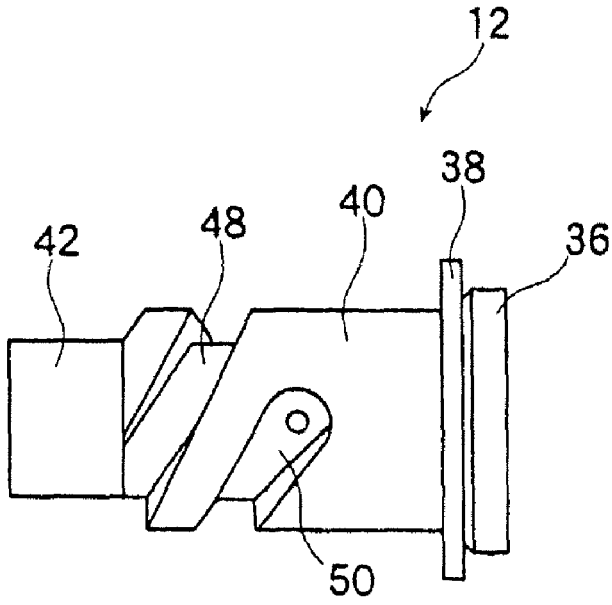
FIG. 4(*a*) is a plan view of an inner cylinder part, and FIG. 4(*b*) is an exploded view of an outer peripheral side of the inner cylinder part.
Figure 4B:
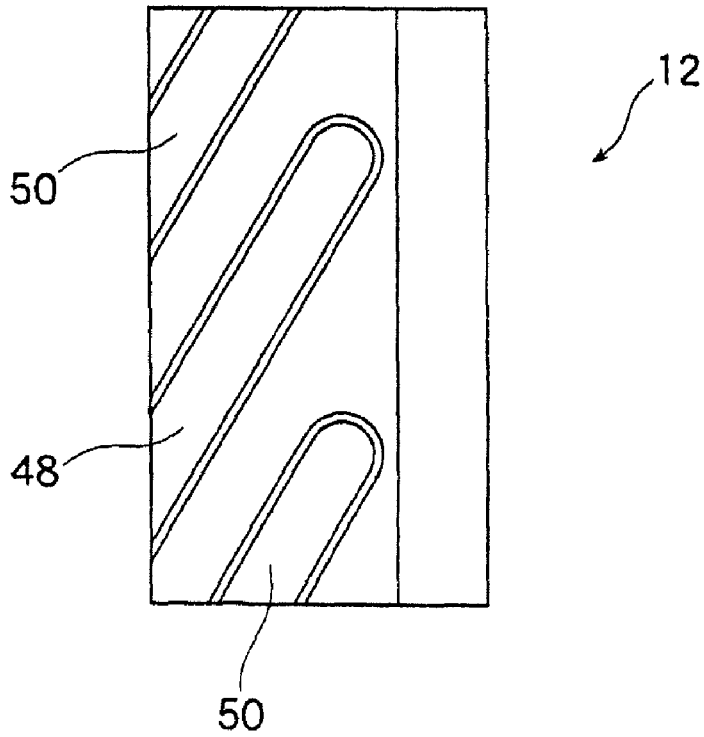
Figure 5C:
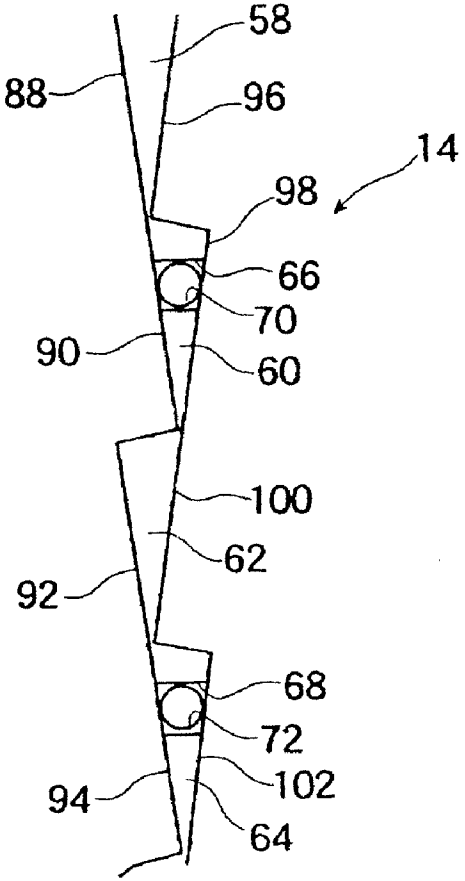
FIG. 5(*a*) is a plan view of an intermediate member, FIG. 5(*b*) is a front view of the intermediate member, and FIG. 5(*c*) is an exploded view of an outer peripheral side of the intermediate member.
Figure 5B:
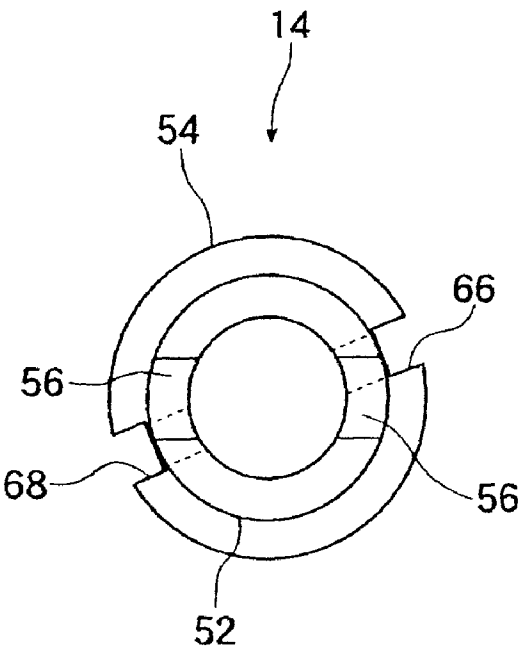
Figure 5A:
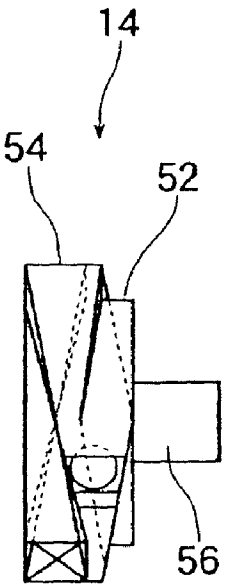
Figure 6:
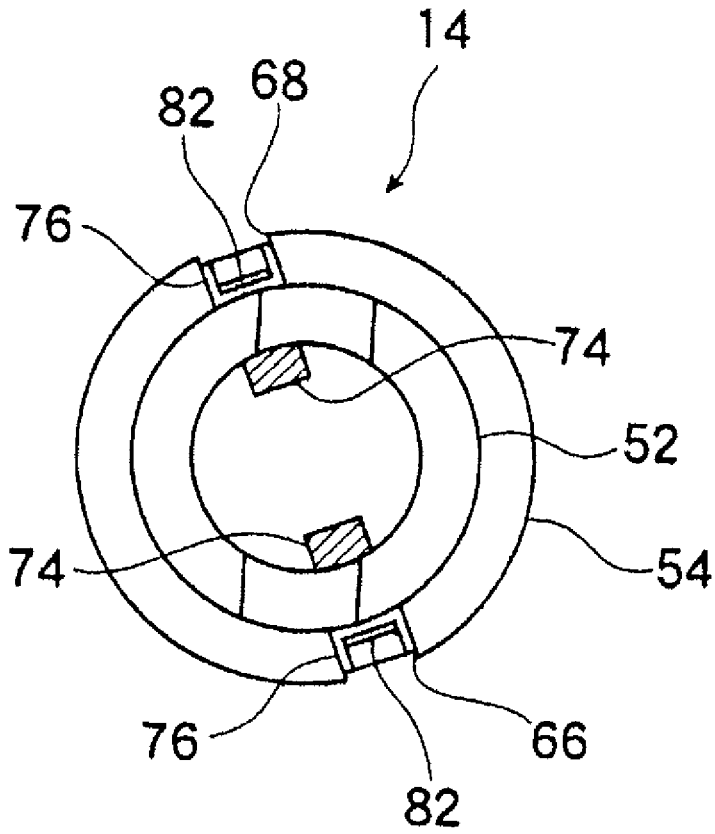
FIG. 6 is a view showing a state where a pin and a roller are fitted in the intermediate member.
Figure 7A:
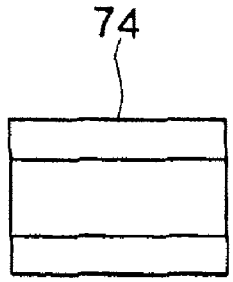
FIG. 7(*a*) is a sectional view of the pin, FIG. 7(*b*) is a plan view of the roller, FIG. 7(*c*) is a sectional view of the roller, and FIG. 7(*d*) is a plan view of a roller pin.
Figure 7B:
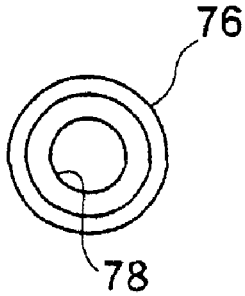
Figure 7C:
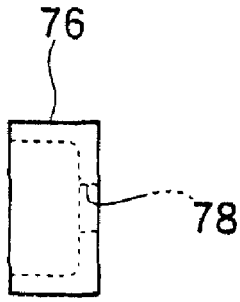
Figure 7D:
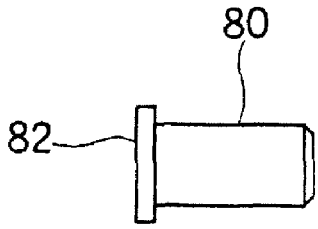
Figure 8B:
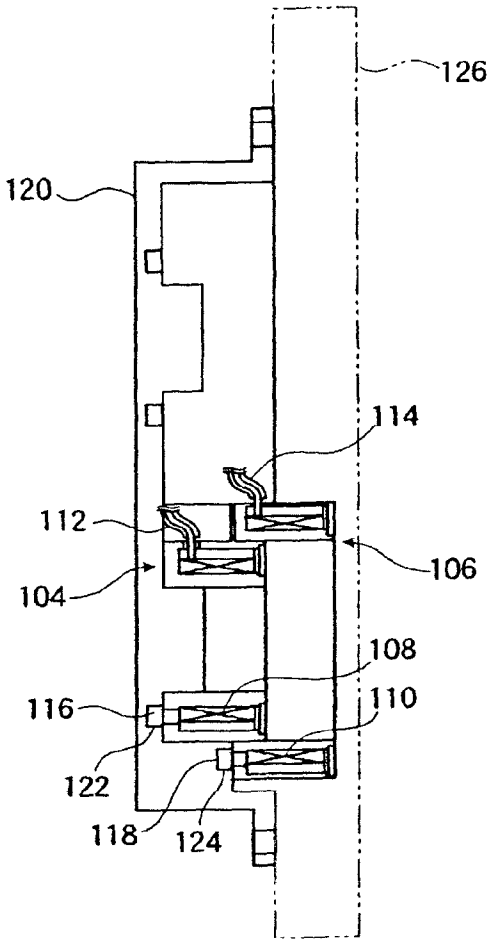
FIG. 8(*a*) is a back view of a cover, and FIG. 8(*b*) is a sectional view along a line A-A of FIG. 8(*a*).
Figure 8A:
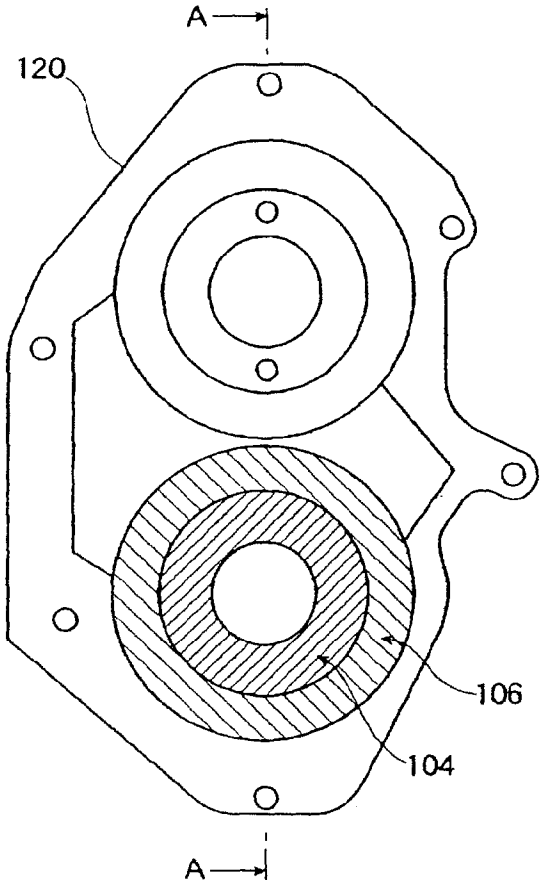
Figure 9C:
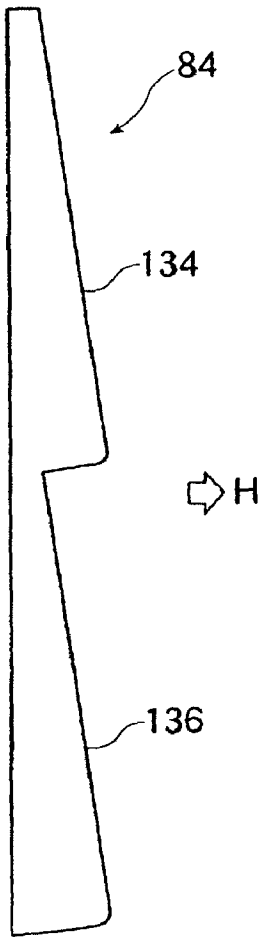
FIG. 9(*a*) is a plan view of a front-side rotary drum, FIG. 9(*b*) is a front view of the front-side rotary drum, and FIG. 9(*c*) is an exploded view of an outer peripheral side of the front-side rotary drum.
Figure 9B:
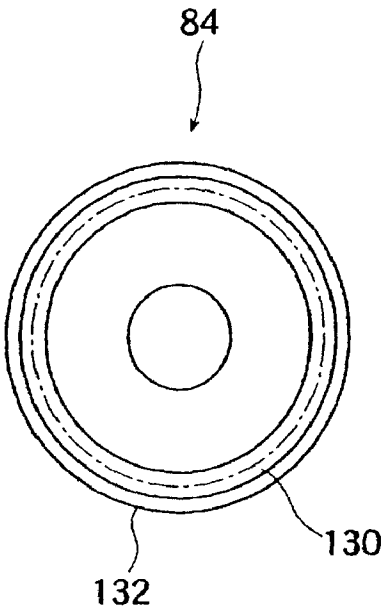
Figure 9A:
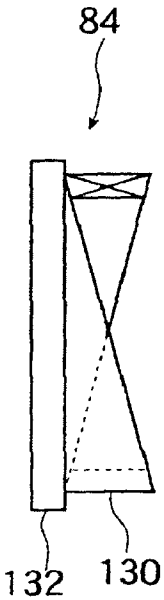
Figure 10C:
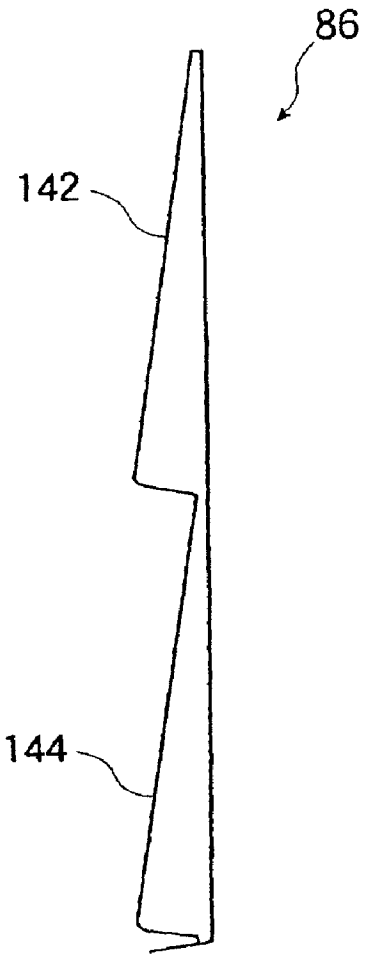
FIG. 10(*a*) is a front view of a rear-side rotary drum, FIG. 10(*b*) is a sectional view of the rear-side rotary drum, and FIG. 10(*c*) is an exploded view of an inner peripheral side of the rear-side rotary drum.
Figure 10B:
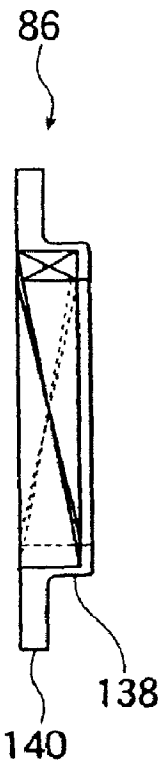
Figure 10A:
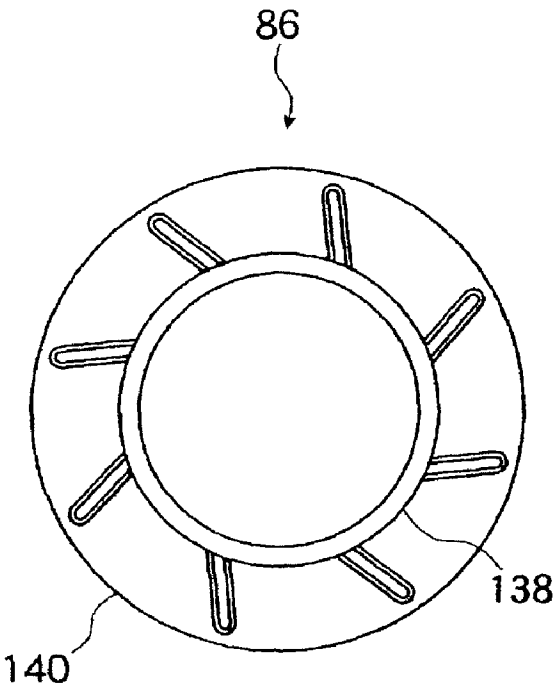
Figure 11A:
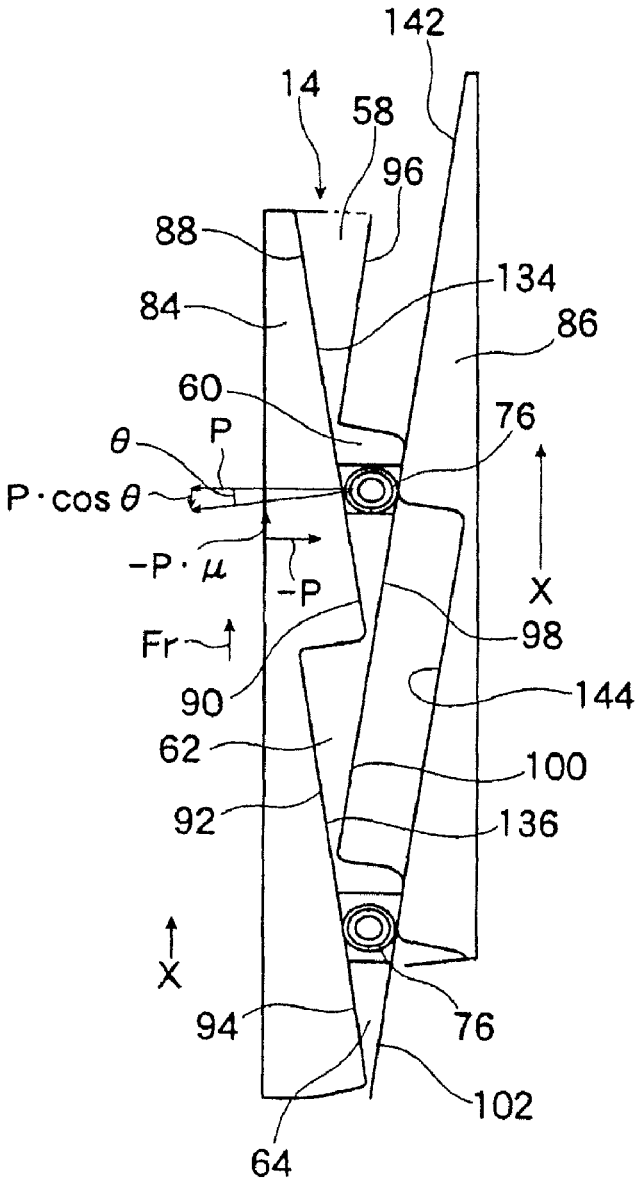
FIG. 11(*a*) is an exploded view for explaining the relationship between the front-side rotary drum and rear-side rotary drum and the intermediate member, and FIG. 11(*b*) is a view for explaining the rotational direction of the inner cylinder part.
Figure 11B:
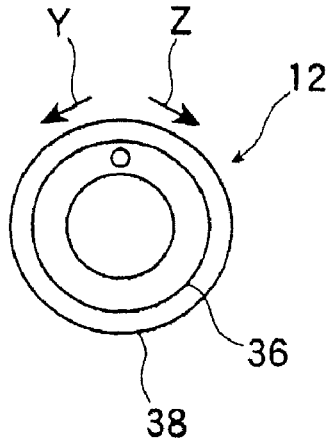
Figure 12:
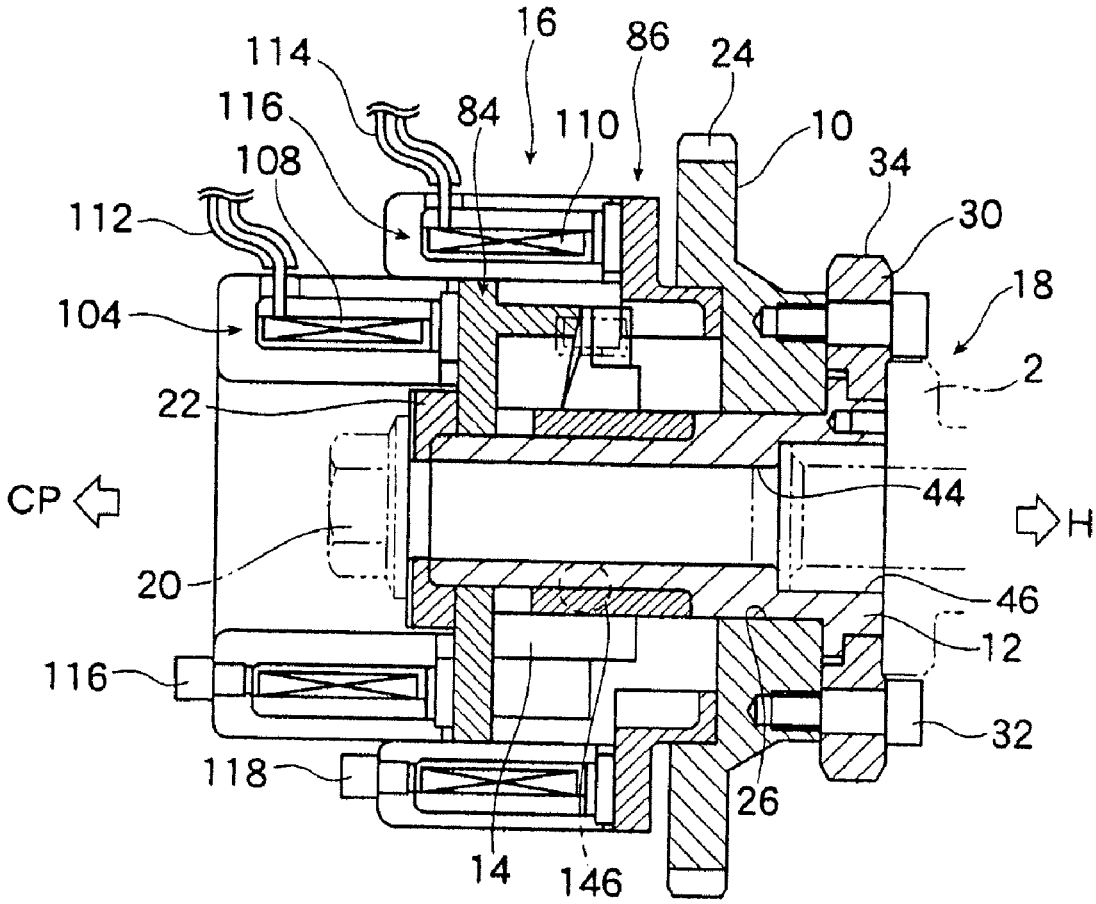
FIG. 12 is a longitudinal sectional view of an engine valve controller showing a second embodiment of the present invention.
Figure 13:
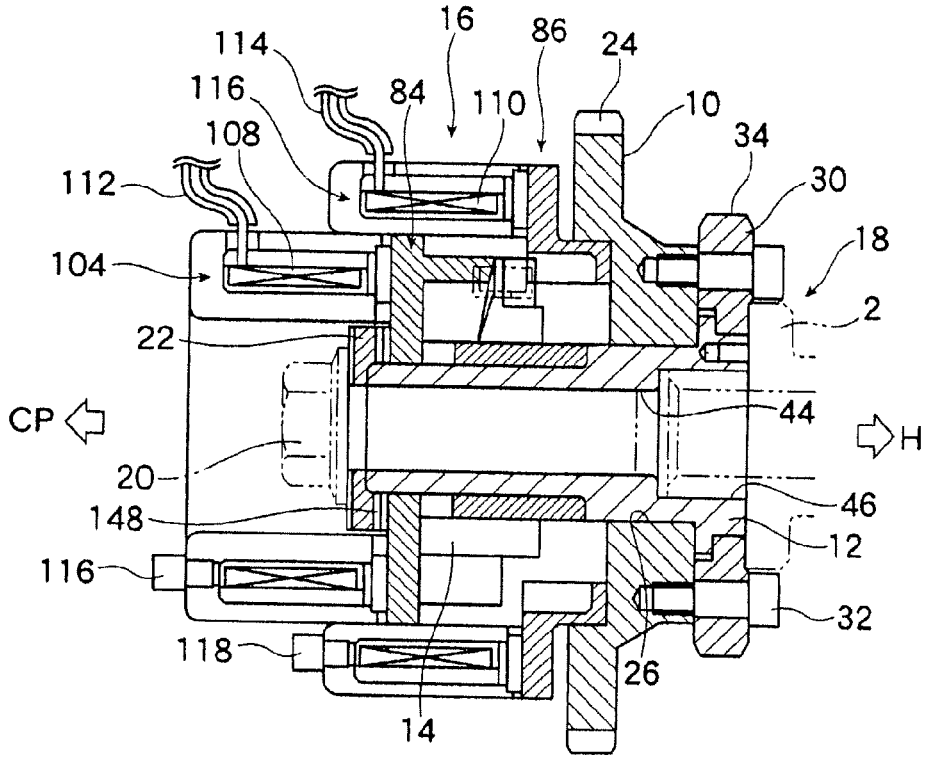
FIG. 13 is a longitudinal sectional view of an engine valve controller showing a third embodiment of the present invention.
Figure 14:
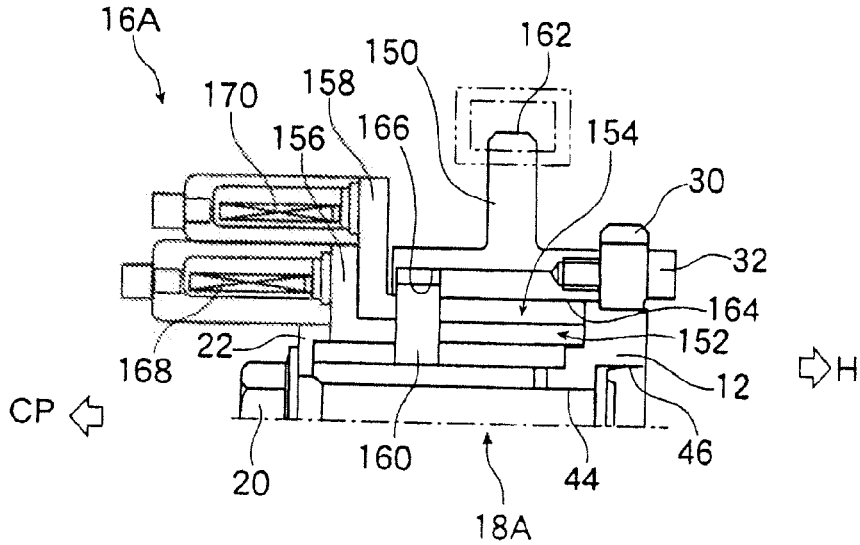
FIG. 14 is a longitudinal sectional view of the main part of an engine valve controller showing a fourth embodiment of the present invention.
Figure 15:
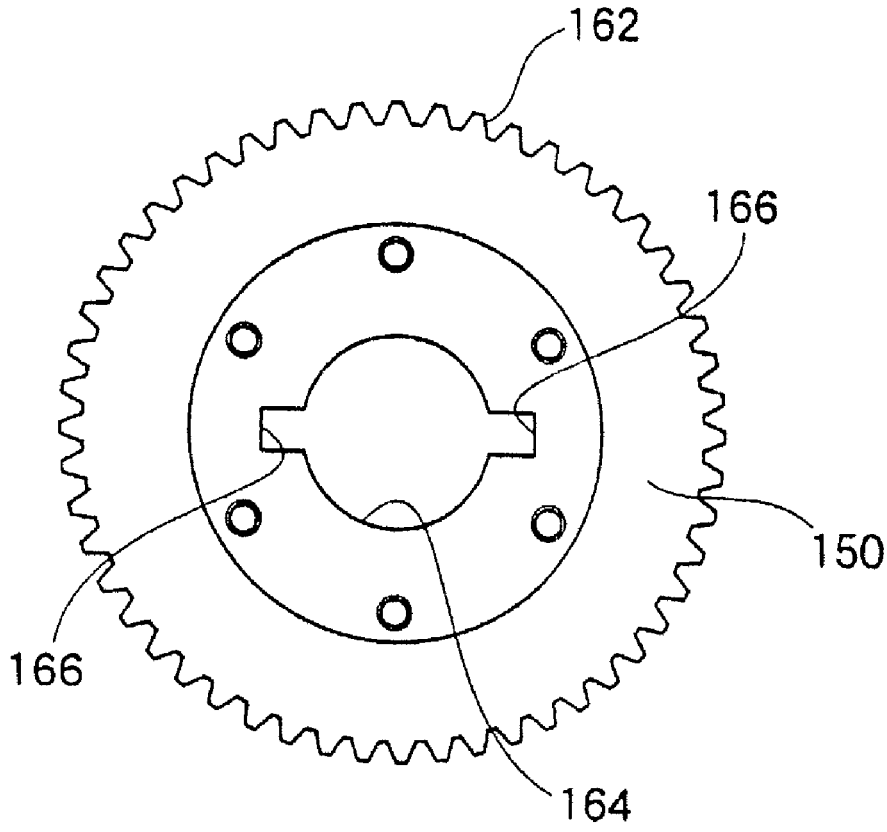
FIG. 15 is a back view of an outer cylinder part in the fourth embodiment.
Figure 16A:
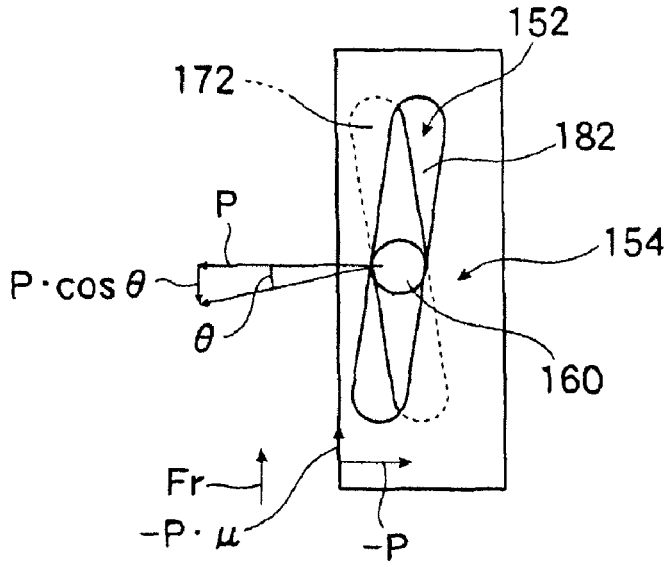
FIG. 16(*a*) is a view for explaining the relationship between the front-side rotary drum and the rear-side rotary drum in the fourth embodiment, FIG. 16(*b*) is an exploded view of an outer peripheral side of the front-side rotary drum in the fourth embodiment, and FIG. 16(*c*) is an exploded view of an outer peripheral side of the rear-side rotary drum in the fourth embodiment.
Figure 16B:
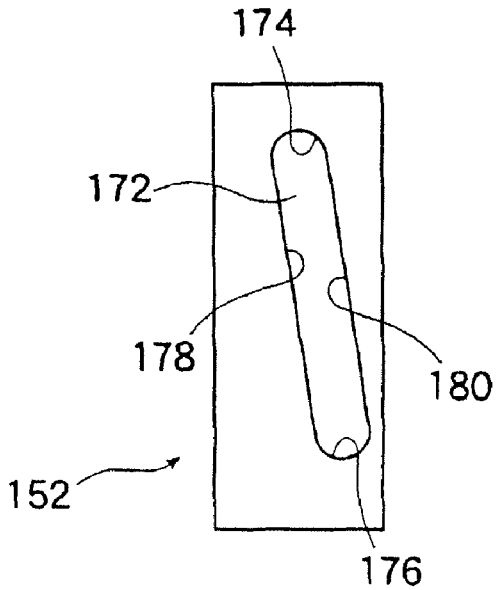
Figure 16C:
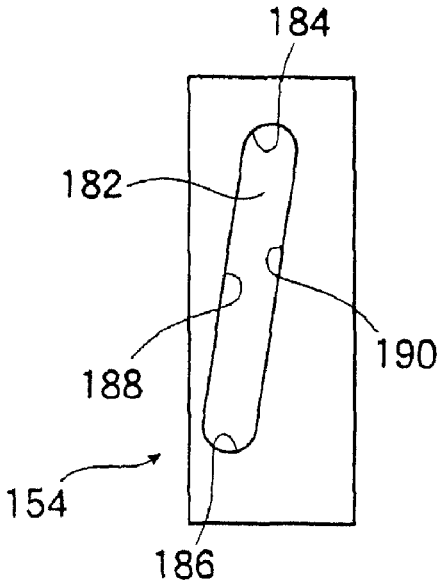
Figure 17:
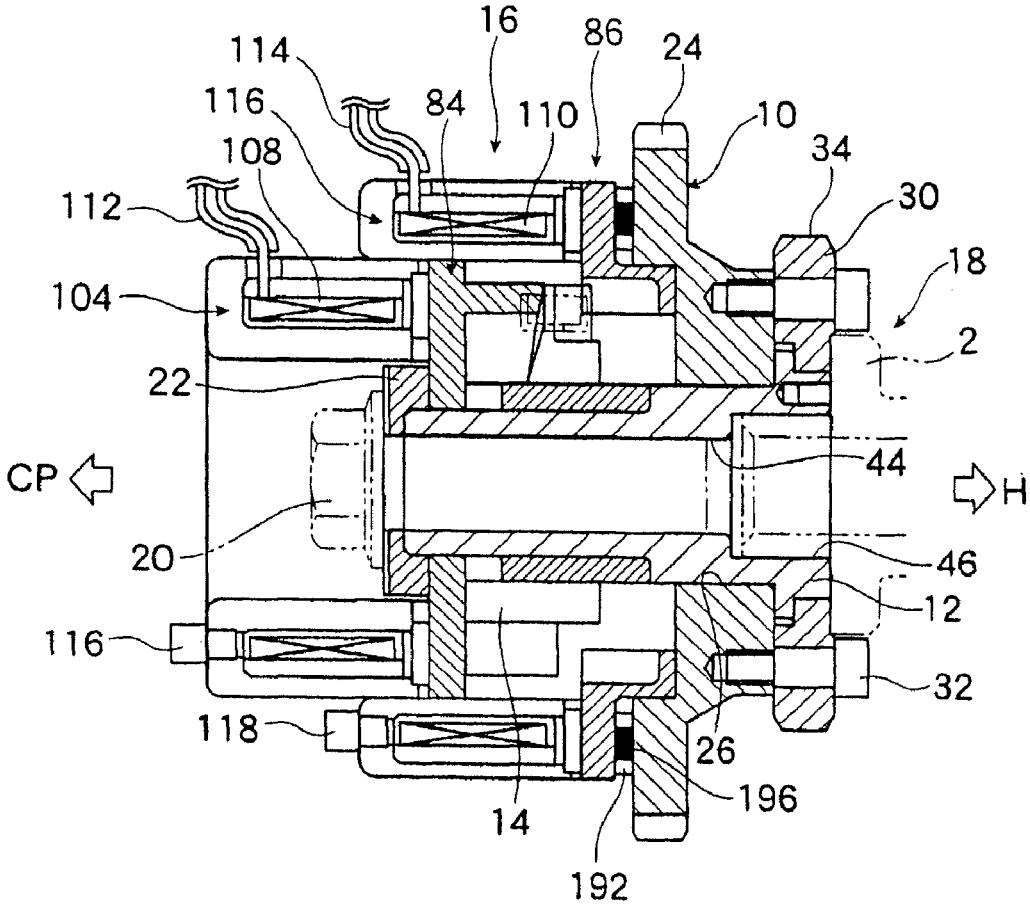
FIG. 17 is a longitudinal sectional view of the main part of an engine valve controller showing a fifth embodiment of the present invention.
Figure 18:
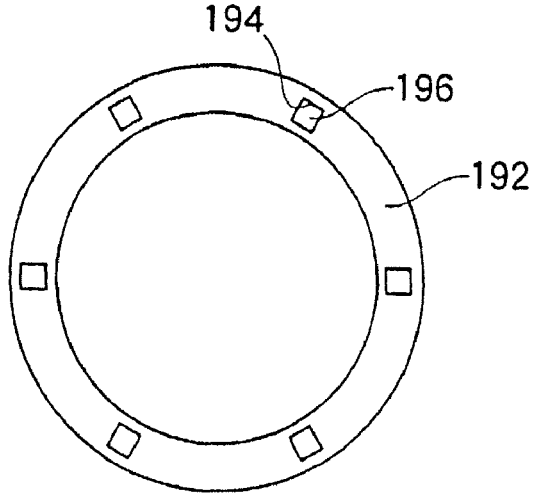
FIG. 18 is a front view of a retainer in the fifth embodiment.
Figure 19:
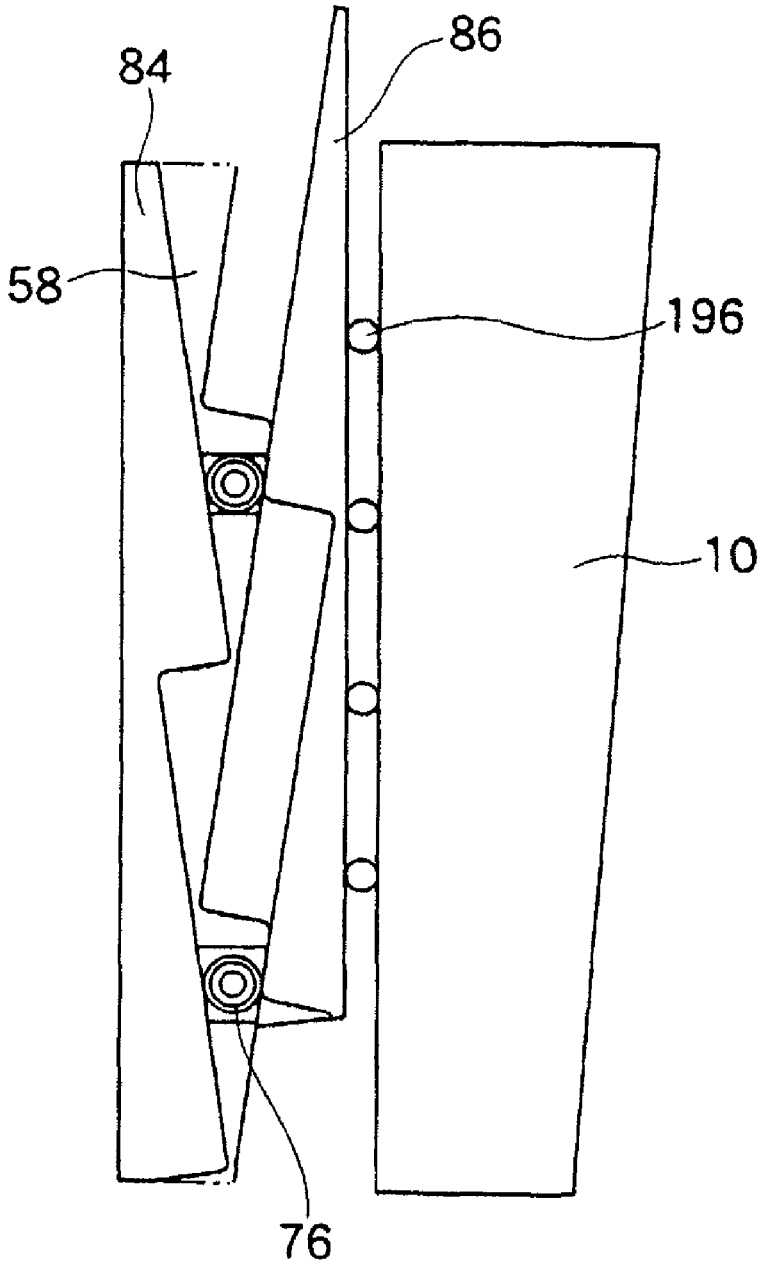
FIG. 19 is an exploded view for explaining the relationship between the rear-side rotary drum and roller and the outer cylinder part in the fifth embodiment.

10 Outer cylinder part
12 Inner cylinder part
14 Intermediate member
16, 16A Position control mechanism
18, 18A Phase adjustment mechanism
30 Small-diameter outer cylinder part
48, 50 Guide groove
74 Pin

76 Roller
84, 86 Rotary drum
88, 90, 92, 94, 96, 98, 100, 102 Ramp
104, 106 Electromagnetic clutch
108, 110 Solenoid
134, 136, 142, 144 Ramp
146 Ball
148 Disc spring
150 Outer cylinder part
152, 154 Rotary drum
156, 158 Electromagnetic clutch
160 Connection pin
166 Guide hole
168, 170 Solenoid
192 Retainer
196 Roller

The invention claimed is:

1. An engine valve controller including an outer cylinder part to which a driving force of a crankshaft of an engine is transmitted, an inner cylinder part disposed relatively rotatable at an inner peripheral side of the outer cylinder part, and coaxially connected to a camshaft that opens and closes an intake valve or an exhaust valve of the engine, an intermediate member formed in a cylindrical shape and a part of which is freely slidably connected to the outer cylinder part, and disposed on an outer periphery of the inner cylinder part freely movably along an axial direction of the inner cylinder part, a position control mechanism that controls a position in an axial direction of the intermediate member according to an operation condition of the engine, and a phase adjustment mechanism that variably adjusts a phase between a sprocket on an outer periphery of the outer cylinder part and the camshaft according to a position in the axial direction of the intermediate member, wherein the inner cylinder part and the intermediate member are connected to each other via the phase adjustment mechanism, the position control mechanism displaces the intermediate member in the axial direction in a current carrying state, and prevents, in a non-current carrying state, to a torque input from the sprocket on the outer periphery of the outer cylinder part or the camshaft to the intermediate member, an axial displacement of the intermediate member resulting from the torque input, the phase adjustment mechanism includes a pin fixed to the intermediate member and a part of which is protruded from an inner periphery of the intermediate member toward the outer periphery of the inner cylinder part and a guide groove formed spirally on the outer periphery of the inner cylinder part as a groove that guides the pin from a position corresponding to a most advanced angle phase to a position corresponding to a most retarded angle phase, and the pin moves within the guide groove according to an axial displacement of the intermediate member, to impart a force resulting from the axial displacement of the intermediate member to the guide groove as a force for a circumferential displacement of the inner cylinder part, and converts, in response to an axial displacement of the intermediate member, the axial displacement of the intermediate member to a circumferential displacement of the inner cylinder part, wherein the position control mechanism includes a first ramp formed, at one axial end side of an outer periphery of the intermediate member, in a direction inclined with respect to a line perpendicular to a central axis of the intermediate member and along a circumferential direction, a second ramp formed, at the other axial end side of the outer periphery of the intermediate member, in a direction inclined in an opposite direction to the first ramp with respect to a line perpendicular to a central axis of the intermediate member and along a circumferential direction, a plurality of rotary drums disposed, with the first ramp and the second ramp interposed therebetween, separated from each other on the outer peripheral side of the intermediate member, and rotatably disposed around the inner cylinder part, a plurality of electromagnetic clutches that generate an electromagnetic force at an advance angle and a retard angle, stop generating an electromagnetic force in other cases, impart a rotating force to one of the rotary drums at the advance angle, and at the retard angle, impart a rotating force to the other of the rotary drums, and a roller that is freely rotatably disposed at a section between the one rotary drum and the other rotary drum of the outer periphery of the intermediate member, and rotates receiving a rotating force from the one rotary drum or the other rotary drum, and on an opposed surface side of the one rotary drum to the other rotary drum, a third ramp that is engageable with the first ramp and for pressing the first ramp toward the camshaft is formed, and on an opposed surface side of the other rotary drum to the one rotary drum, a fourth ramp that is engageable with the second ramp and for pressing the second ramp in a direction to separate from the camshaft is formed.

2. The engine valve controller according to claim 1, wherein where an inclination angle of the first ramp, second ramp, third ramp, and fourth ramp is provided as θ, a force acting from the roller on the one rotary drum or the other rotary drum, which is a force parallel with a central axis of each rotary drum, is provided as P, journal friction acting in the circumferential direction of the one rotary drum or the other rotary drum is provided as Fr, and a coefficient of friction between the one rotary drum or the other rotary drum and the intermediate member is provided as μ, to a torque input from the outer cylinder part or camshaft to the intermediate member when the intermediate member is at an arbitrary advanced angle position or retarded angle position and an axial displacement for the intermediate member is not performed, the inclination angle θ satisfies a relationship of:

$$P\times\cos(\theta)-P\times\mu-Fr<0.$$

3. The engine valve controller according to claim 1, wherein the rotary drums are disposed between a stopper fixed to an outer periphery of one axial end portion of the inner cylinder part and the outer cylinder part, an elastic body is mounted between one of the rotary drums and the stopper, and by an elastic force of the elastic body, the rotary drums are pressed toward the camshaft.

4. The engine valve controller according to claim 1, wherein a ring-shaped retainer is mounted between a rotary drum adjacent to the outer cylinder part of the rotary drums and the outer cylinder part, and in the retainer, a plurality of through-holes are formed dispersed along the circumferential direction, and in each through-hole, a rotor that is in contact with the rotary drum and the outer cylinder part is freely rotatably mounted.

5. An engine valve controller including an outer cylinder part to which a driving force of a crankshaft of an engine is transmitted, an inner cylinder part disposed relatively rotatable at an inner peripheral side of the outer cylinder part, and coaxially connected to a camshaft that opens and closes an intake valve or an exhaust valve of the engine, an intermediate member formed in a cylindrical shape and a part of which is freely slidably connected to the outer cylinder part, and disposed on an outer periphery of the inner cylinder part freely movably along an axial direction of the inner cylinder part, a position control mechanism that controls a position in an axial direction of the intermediate member according to an operation condition of the engine, and a phase adjustment mechanism that variably adjusts a phase between a sprocket on an outer periphery of the outer cylinder part and the camshaft according to a position in the axial direction of the intermediate member, wherein the inner cylinder part and the intermediate member are connected to each other via the phase adjustment mechanism, the position control mechanism displaces the intermediate member in the axial direction in a current carrying state, and prevents, in a non-current carrying state, to a torque input from the sprocket on the outer periphery of the outer cylinder part or the camshaft to the intermediate member, an axial displacement of the intermediate member resulting from the torque input, the phase adjustment mechanism includes a ball fixed to the intermediate member and a part of which is protruded from an inner periphery of the intermediate member toward the outer periphery of the inner cylinder part and a guide groove formed spirally on the outer periphery of the inner cylinder part as a groove that guides the ball from a position corresponding to a most advanced angle phase to a position corresponding to a most retarded angle phase, and the ball moves within the guide groove according to an axial displacement of the intermediate member, to impart a force resulting from the axial displacement of the intermediate member to the guide groove as a force for a circumferential displacement of the inner cylinder part, and converts, in response to an axial displacement of the intermediate member, the axial displacement of the intermediate member to a circumferential displacement of the inner cylinder part, wherein the position control mechanism includes a first ramp formed, at one axial end side of an outer periphery of the intermediate member, in a direction inclined with respect to a line perpendicular to a central axis of the intermediate member and along a circumferential direction, a second ramp formed, at the other axial end side of the outer periphery of the intermediate member, in a direction inclined in an opposite direction to the first ramp with respect to a line perpendicular to a central axis of the intermediate member and along a circumferential direction, a plurality of rotary drums disposed, with the first ramp and the second ramp interposed therebetween, separated from each other on the outer peripheral side of the intermediate member, and rotatably disposed around the inner cylinder part, a plurality of electromagnetic clutches that generate an electromagnetic force at an advance angle and a retard angle, stop generating an electromagnetic force in other cases, impart a rotating force to one of the rotary drums at the advance angle, and at the retard angle, impart a rotating force to the other of the rotary drums, and a roller that is freely rotatably disposed at a section between the one rotary drum and the other rotary drum of the outer periphery of the intermediate member, and rotates receiving a rotating force from the one rotary drum or the other rotary drum, and on an opposed surface side of the one rotary drum to the other rotary drum, a third ramp that is engageable with the first ramp and for pressing the first ramp toward the camshaft is formed, and on an opposed surface side of the other rotary drum to the one rotary drum, a fourth ramp that is engageable with the second ramp and for pressing the second ramp in a direction to separate from the camshaft is formed.

6. An engine valve controller including an outer cylinder part to which a driving force of a crankshaft of an engine is transmitted, an inner cylinder part disposed relatively rotatable at an inner peripheral side of the outer cylinder part, and coaxially connected to a camshaft that opens and closes an intake valve or an exhaust valve of the engine, a connection pin disposed freely movably along an axial direction of the inner cylinder part, for connecting the inner peripheral side of the outer cylinder part and an outer peripheral side of the inner cylinder part, a position control mechanism that controls a position of the connection pin in the axial direction of the inner cylinder part according to an operation condition of the engine, and a phase adjustment mechanism that variably adjusts a phase between a sprocket on an outer periphery of the outer cylinder part and the camshaft according to a position of the connection pin in the axial direction of the inner cylinder part, wherein the position control mechanism displaces the connection pin in the axial direction of the inner cylinder part in a current carrying state, and prevents, in a non-current carrying state, to a torque input from the sprocket on the outer periphery of the outer cylinder part or the camshaft to the connection pin, a displacement of the connection pin in the axial direction of the inner cylinder part resulting from the torque input, the phase adjustment mechanism includes, as grooves that guide the connection pin from a position corresponding to a most advanced angle phase to a position corresponding to a most retarded angle phase, a first guide groove formed spirally on the outer periphery of the inner cylinder part and a second guide groove formed, on the inner periphery of the outer cylinder part, along an axial direction of the outer cylinder part, both end sides of the connection pin move within the first guide groove and second guide groove according to an axial displacement by the position control mechanism, to impart a force resulting from the axial displacement by the position control mechanism as a force for a circumferential displacement of the inner cylinder part, and converts, in response to a displacement of the connection pin in the axial direction of the inner cylinder part, the displacement of the connection pin in the axial direction of the inner cylinder part to a circumferential displacement of the inner cylinder part, wherein the position control mechanism includes a plurality of rotary drums freely rotatably disposed between the inner cylinder part and the outer cylinder part, and disposed adjacent to each other along a radial direction of the outer cylinder part, and a plurality of electromagnetic clutches that generate an electromagnetic force in a current carrying state, stop generating an electromagnetic force in a non-current carrying state, impart a rotating force to one of the rotary drums at an advance angle resulting from a current supply, and at a retard angle resulting from a current supply, impart a rotating force to the other of the rotary drums, and in one of the rotary drums, a first guide hole to insert therethrough the connection pin is linearly formed in a direction inclined with respect to a line perpendicular to a central axis of the one rotary drum and along a circumferential direction, in the other rotary drum, a second guide hole to insert therethrough the connection pin is linearly formed in a direction inclined in an opposite direction to the first guide hole with respect to a line perpendicular to a central axis of the other rotary drum and along a circumferential direction, a pair of edges along a longitudinal direction of the first guide hole are formed as first ramps, and a pair of edges along a longitudinal direction of the second guide hole are formed as second ramps.

7. The engine valve controller according to claim 6, wherein where an inclination angle of the first ramp and second ramp is provided as $\theta$, a force acting from the connection pin on the one rotary drum or the other rotary drum, which is a force parallel with a central axis of each rotary drum, is provided as P, journal friction acting in the circumferential direction of the one rotary drum or the other rotary drum is provided as Fr, and a coefficient of friction between the one rotary drum or the other rotary drum and the connection pin is provided as μ, to a torque input from the outer cylinder part or camshaft to the connection pin when the connection pin is at an arbitrary advanced angle position or retarded angle position and an axial displacement along the axial direction of the inner cylinder part for the connection pin is not performed, the inclination angle θ satisfies a relationship of:

$$P\times\cos(\theta)-P\times\mu-Fr<0.$$

* * * * *